US010436463B2

(12) United States Patent
Motomura et al.

(10) Patent No.: US 10,436,463 B2
(45) Date of Patent: Oct. 8, 2019

(54) AIR-CONDITIONING APPARATUS

(71) Applicants: Yuji Motomura, Tokyo (JP); Osamu Morimoto, Tokyo (JP); Daisuke Shimamoto, Tokyo (JP); Takayoshi Honda, Tokyo (JP)

(72) Inventors: Yuji Motomura, Tokyo (JP); Osamu Morimoto, Tokyo (JP); Daisuke Shimamoto, Tokyo (JP); Takayoshi Honda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 36 days.

(21) Appl. No.: 14/439,809

(22) PCT Filed: Nov. 29, 2012

(86) PCT No.: PCT/JP2012/080919

§ 371 (c)(1),
(2) Date: Apr. 30, 2015

(87) PCT Pub. No.: WO2014/083652

PCT Pub. Date: Jun. 5, 2014

(65) Prior Publication Data

US 2015/0292757 A1 Oct. 15, 2015

(51) Int. Cl.
*F24F 5/00* (2006.01)
*F25B 13/00* (2006.01)
(Continued)

(52) U.S. Cl.
CPC ..... *F24F 5/001* (2013.01); *F25B 13/00* (2013.01); *F25B 25/005* (2013.01); *F25B 49/02* (2013.01);
(Continued)

(58) Field of Classification Search
CPC ..... F25B 25/005; F25B 2313/006; F25B 2313/0231; F25B 2313/0293;
(Continued)

(56) References Cited

U.S. PATENT DOCUMENTS 4,644,756 A * 2/1987 Sugimoto ..... F24F 3/065 62/160
5,263,333 A * 11/1993 Kubo ..... F24F 3/065 62/160
(Continued)

FOREIGN PATENT DOCUMENTS

EP 2341297 A1 7/2011
JP 05-280818 A 10/1993
(Continued)

OTHER PUBLICATIONS

"Machine Translation of JP 2005-140369, Sasaki, Feb. 2005".*
(Continued)

*Primary Examiner* — Frantz F Jules
*Assistant Examiner* — Martha Tadesse
(74) *Attorney, Agent, or Firm* — Posz Law Group, PLC

(57) ABSTRACT

Upon switching of an air-conditioning apparatus from an operation mode in which all of indoor units each including a use side heat exchanger are in non-operation to another operation mode in which at least one of the indoor units starts a cooling operation mode or a heating operation mode, a heat medium conveyed to the use side heat exchanger included in the indoor unit which has received a start instruction is cooled or heated to a predetermined temperature by a heat source side refrigerant, and after that, an air-sending device included in the indoor unit which starts the cooling operation mode or the heating operation mode is actuated.

4 Claims, 10 Drawing Sheets

(51) Int. Cl.
*F25B 25/00* (2006.01)
*F25B 49/02* (2006.01)
*F24F 3/06* (2006.01)

(52) U.S. Cl.
CPC ..... *F24F 3/065* (2013.01); *F25B 2313/006* (2013.01); *F25B 2313/0231* (2013.01); *F25B 2313/0272* (2013.01); *F25B 2313/0293* (2013.01); *F25B 2313/02743* (2013.01)

(58) Field of Classification Search
CPC .... F25B 2313/0272; F25B 2313/02743; F24F 3/10; F24F 5/001
See application file for complete search history.

(56) References Cited

U.S. PATENT DOCUMENTS 5,297,392 A * 3/1994 Takata ..... F24F 3/065 236/49.3
7,464,563 B2 * 12/2008 Park ..... F25B 7/00 62/324.6
8,616,017 B2 * 12/2013 Shimazu ..... F24F 3/065 62/335
9,273,875 B2 * 3/2016 Yamashita ..... F24F 3/06
9,353,979 B2 * 5/2016 Morimoto ..... F24F 3/06
9,366,452 B2 * 6/2016 Takenaka ..... F24F 3/06
2007/0130978 A1 * 6/2007 Honda ..... F25B 13/00 62/238.7
2011/0167865 A1 * 7/2011 Morimoto ..... F24F 3/06 62/513
2011/0192184 A1 * 8/2011 Yamashita ..... F24F 1/02 62/196.1
2011/0192189 A1 * 8/2011 Morimoto ..... F24F 3/06 62/513
2011/0197608 A1 * 8/2011 Yamashita ..... F24F 3/06 62/190
2011/0297363 A1 * 12/2011 Takata ..... F24F 3/06 165/270
2012/0006050 A1 1/2012 Takayama et al.
2012/0043056 A1 * 2/2012 Shimazu ..... F24F 3/065 165/96
2013/0061622 A1 * 3/2013 Kubota ..... F25B 7/00 62/238.6
2013/0269379 A1 * 10/2013 Ue ..... F24F 1/32 62/160
2014/0196483 A1 * 7/2014 Okazaki ..... F25B 49/02 62/79
2014/0260387 A1 * 9/2014 Takenaka ..... F24F 3/065 62/205
2015/0128628 A1 * 5/2015 Kawagoe ..... F25B 13/00 62/160
2015/0285518 A1 * 10/2015 Shimamoto ..... F25B 13/00 62/186

FOREIGN PATENT DOCUMENTS

JP 2001-289465 A 10/2001
JP 2003-343936 A 12/2003
JP 2005-140369 A 6/2005
JP 2005-140444 A 6/2005
WO 2010/049998 A1 5/2010

OTHER PUBLICATIONS

Office Action dated Nov. 10, 2015 in the corresponding JP application No. 2014-549701 (with English translation).
International Search Report of the International Searching Authority dated Feb. 19, 2013 for the corresponding international application No. PCT/JP2012/080919 (and English translation).
Extended European Search Report dated Jul. 14, 2016 in the corresponding EP application No. 12888982.1.
Office Action dated Dec. 16, 2016 issued in the corresponding Chinese patent application No. 201280077260.8 (and English translation).

* cited by examiner

AIR-CONDITIONING APPARATUS

CROSS REFERENCE TO RELATED APPLICATION

This application is a U.S. national stage application of International Application No. PCT/JP2012/080919 filed on Nov. 29, 2012, the disclosure of which is incorporated by reference.

TECHNICAL FIELD

The present invention relates to an air-conditioning apparatus which is used as, for example, a multi-air-conditioning apparatus for a building.

BACKGROUND ART

In a related-art air-conditioning apparatus, such as a multi-air-conditioning apparatus for a building, refrigerant is circulated between an outdoor unit, functioning as a heat source unit, disposed outside a structure, for example, and an indoor unit disposed in an indoor space in the structure. The refrigerant transfers or removes heat to or from air to heat or cool the air, thus heating or cooling an air-conditioned space with the heated or cooled air. As regards the refrigerant used in such an air-conditioning apparatus, for example, a hydrofluorocarbon (HFC) refrigerant is often used. An air-conditioning apparatus recently developed uses a natural refrigerant, such as carbon dioxide ($CO_2$).

In an air-conditioning apparatus called a chiller, cooling energy or heating energy is produced in a heat source unit disposed outside a structure. Water, antifreeze, or the like is heated or cooled by a heat exchanger included in an outdoor unit and it is conveyed to a fan coil unit or a panel heater, serving as an indoor unit, to perform heating or cooling (refer to Patent Literature 1, for example).

An air-conditioning apparatus called an exhaust-heat recovery chiller is configured such that a heat source unit is connected to each indoor unit by four water pipes arranged therebetween and, for example, cooled water and heated water are simultaneously supplied to the indoor units so that cooling or heating can be freely selected in each indoor unit (refer to Patent Literature 2, for example).

Another air-conditioning apparatus recently developed is configured such that a heat exchanger for a primary refrigerant and a secondary refrigerant is disposed near each indoor unit to convey the secondary refrigerant to the indoor unit (refer to Patent Literature 3, for example).

Still another air-conditioning apparatus recently developed is configured such that an outdoor unit is connected to each branching unit including a heat exchanger by two pipes and a secondary refrigerant is conveyed to an indoor unit (refer to Patent Literature 4, for example).

Air-conditioning apparatuses, such as a multi-air-conditioning apparatus for a building, include an air-conditioning apparatus configured such that refrigerant is circulated from an outdoor unit to a relay unit and a heat medium, such as water, is circulated from the relay unit to each indoor unit to reduce conveyance power for the heat medium while circulating the heat medium, such as water, through the indoor unit (refer to Patent Literature 5, for example).

CITATION LIST

Patent Literature

Patent Literature 1: Japanese Unexamined Patent Application Publication No. 2005-140444 (Page 4, FIG. 1, for example)

Patent Literature 2: Japanese Unexamined Patent Application Publication No. 5-280818 (Pages 4 and 5, FIG. 1, for example)

Patent Literature 3: Japanese Unexamined Patent Application Publication No. 2001-289465 (Pages 5 to 8, FIGS. 1 and 2, for example)

Patent Literature 4: Japanese Unexamined Patent Application Publication No. 2003-343936 (Page 5, FIG. 1)

Patent Literature 5: International Publication No. WO 10/049998 (Page 3, FIG. 1, for example)

SUMMARY OF INVENTION

Technical Problem

In a related-art air-conditioning apparatus, such as a multi-air-conditioning apparatus for a building, refrigerant may leak into an indoor space or the like because the refrigerant is circulated to an indoor unit. On the other hand, in an air-conditioning apparatus like those disclosed in Patent Literature 1 and Patent Literature 2, refrigerant does not pass through an indoor unit. In such an air-conditioning apparatus like those disclosed in Patent Literature 1 and Patent Literature 2, it is necessary to heat or cool a heat medium in a heat source unit disposed outside a structure and convey the heat medium to the indoor unit. A circulation path for the heat medium is accordingly long. In conveying heat for a predetermined heating or cooling load using the heat medium, the amount of energy consumed as conveyance power and the like by the heat medium is higher than that by the refrigerant. As the circulation path is longer, the conveyance power markedly increases. This indicates that proper control of the circulation of the heat medium in the air-conditioning apparatus results in energy saving.

In an air-conditioning apparatus like that disclosed in Patent Literature 2, each indoor space has to be connected to an outdoor side by four pipes so that cooling or heating can be selected in each indoor unit. Unfortunately, ease of construction is poor. In the air-conditioning apparatus disclosed in Patent Literature 3, secondary medium circulating means, such as a pump, has to be provided for each indoor unit, leading to large noise as well as high cost of such a system. This apparatus is impractical. In addition, since the heat exchanger is disposed near each indoor unit, a likelihood that the refrigerant may leak into a place near an indoor space cannot be eliminated.

In an air-conditioning apparatus like that disclosed in Patent Literature 4, a primary refrigerant subjected to heat exchange flows into the same passage as that for the primary refrigerant to be subjected to heat exchange. If the air-conditioning apparatus includes a plurality of indoor units, each indoor unit will fail to provide a maximum capacity. In such a configuration, energy will be wasted. Furthermore, each branching unit is connected to an extension pipe by two pipes for cooling and two pipes for heating, that is, four pipes in total. Consequently, this configuration is similar to that of a system in which the outdoor unit is connected to each branching unit by four pipes. Accordingly, the ease of construction of such a system is poor.

In an air-conditioning apparatus like that disclosed in Patent Literature 5, there is no problem in the use of a single refrigerant or a near-azeotropic refrigerant. In the use of a non-azeotropic refrigerant mixture, however, the performance of heat exchange between the refrigerant and a heat medium may decrease due to a temperature glide between a saturated liquid temperature and a saturated gas temperature of the refrigerant while a refrigerant-and-heat-medium heat exchanger is used as an evaporator.

In each of the apparatuses disclosed in Patent Literature 1 to 5, when an operation mode in which all of indoor units connected are in non-operation is shifted to another operation mode in which heating or cooling, alternatively, hot water or cold water is needed, the heat medium has to be heated or cooled using the primary refrigerant and then be conveyed to a target indoor unit. If the indoor unit starts a heating operation or a cooling operation, that is, starts to send air before enough heat to achieve a heating or cooling load is conveyed, the indoor unit will send higher temperature air than a human body temperature in the cooling operation, alternatively, lower temperature air than the human body temperature in the heating operation.

In addition, the temperature of the heat medium which is being conveyed depends on the length of the circulation path to the indoor unit, that is, the total volume of the heat medium. As the total volume of the heat medium is larger, such a phenomenon is more likely to occur.

In each of the apparatuses disclosed in Patent Literature 1 to 5, when an operation mode in which all of the indoor units connected perform the cooling operation is changed to another operation mode in which at least one of the indoor units performs the heating operation, alternatively, when an operation mode in which all of the indoor units connected perform the heating operation is changed to another operation mode in which at least one of the indoor units performs the cooling operation, the heat medium which has been used only as cold water or hot water has to be heated or cooled using the primary refrigerant and then be conveyed to the indoor unit which has changed the operation. To convey heat to achieve a predetermined heating or cooling load, the heat medium has to be heated or cooled using the primary refrigerant and then be conveyed to the indoor unit.

If the indoor unit starts the heating operation or the cooling operation, that is, starts to send air before enough heat to achieve a heating or cooling load is conveyed, the indoor unit will send higher temperature air than the human body temperature in the cooling operation, alternatively, lower temperature air than the human body temperature in the heating operation.

In addition, the temperature of the heat medium which is being conveyed depends on the length of the circulation path to the indoor unit, that is, the total volume of the heat medium. As the total volume of the heat medium is larger, such a phenomenon is more likely to occur.

Accordingly, if the air-conditioning apparatus enables proper control of the temperature of the heat medium circulated depending on an operation mode of each indoor unit, higher temperature air than the human body temperature in the heating operation, alternatively, lower temperature air than the human body temperature in the cooling operation can be conveyed into an indoor space upon switching between operation modes.

The present invention has been made to solve the above-described problem. A first object of the present invention is to provide an air-conditioning apparatus that facilitates transportation of a heat medium at a predetermined temperature to an indoor unit while achieving energy saving upon switching of the apparatus from an operation mode in which all of indoor units are in non-operation to another operation mode in which a heating operation or a cooling operation, alternatively, hot water or cold water is needed.

In other words, the first object of the present invention is to provide an air-conditioning apparatus in which a heat capacity is transferred from an outdoor unit to an indoor unit via a relay unit such that refrigerant is not directly conveyed to the indoor unit and the heat capacity is transferred through a heat medium, and that achieves a comfortable cooling or heating operation by performing the cooling or heating operation after the heat medium reaches a predetermined temperature, because it takes more time to transfer a sufficient amount of heat capacity through the heat medium than through the refrigerant, which enables immediate transfer of the heat capacity by fluctuations in pressure and temperature.

In addition to the first object, a second object of the present invention is to provide an air-conditioning apparatus that, upon switching of the apparatus from an operation mode in which all of indoor units perform a heating operation or need hot water to another operation mode in which at least one indoor unit performs a cooling operation, alternatively, upon switching of the apparatus from an operation mode in which all of the indoor units perform the cooling operation or need cold water to another operation mode in which at least one indoor unit performs the heating operation, achieves a comfortable cooling or heating operation by supplying a heat medium at a predetermined temperature to each indoor unit.

Solution to Problem

The present invention provides an air-conditioning apparatus including a refrigerant circuit through which a heat source side refrigerant is circulated and that includes a compressor, a heat source side heat exchanger, a plurality of expansion devices, and refrigerant passages of a plurality of intermediate heat exchangers which are connected by refrigerant pipes, and a heat medium circuit through which a heat medium is circulated and that include a plurality of pumps, a plurality of use side heat exchangers, and heat medium passages of the intermediate heat exchangers which are connected by heat medium conveying pipes. The intermediate heat exchangers exchange heat between the heat source side refrigerant and the heat medium. Upon switching of the apparatus from an operation mode in which all of a plurality of indoor units each including the use side heat exchanger and an air-sending device are in non-operation to another operation mode in which at least one of the indoor units starts a cooling operation mode or a heating operation mode, the heat medium conveyed to the use side heat exchanger included in the indoor unit which has received a start instruction is cooled or heated to a predetermined temperature by the heat source side refrigerant, and after that, the air-sending device included in the indoor unit which starts the cooling operation mode or the heating operation mode is actuated.

Advantageous Effects of Invention

The air-conditioning apparatus according to the present invention permits the pipes through which the heat medium is circulated to be shortened and accordingly requires less conveyance power, leading to improved safety and energy saving. If the heat medium leaks to the outside of the air-conditioning apparatus according to the present invention, a small amount of heat medium would leak. Accordingly, the safety can be further improved.

In addition, upon switching of the air-conditioning apparatus according to the present invention from the operation mode in which all of the indoor units each including the use side heat exchanger are in non-operation to another operation mode in which at least one of the indoor units starts the cooling operation mode or the heating operation mode, the heat medium conveyed to the use side heat exchanger included in the indoor unit which has received the start instruction is cooled or heated to the predetermined temperature by the heat source side refrigerant, and after that, the air-sending device included in the indoor unit which starts the cooling operation mode or the heating operation mode is actuated. This results in improved comfort upon start of the cooling operation mode or the heating operation mode.

DESCRIPTION OF EMBODIMENTS

Embodiment of the present invention will now be described with reference to the drawings.

Figure 1:
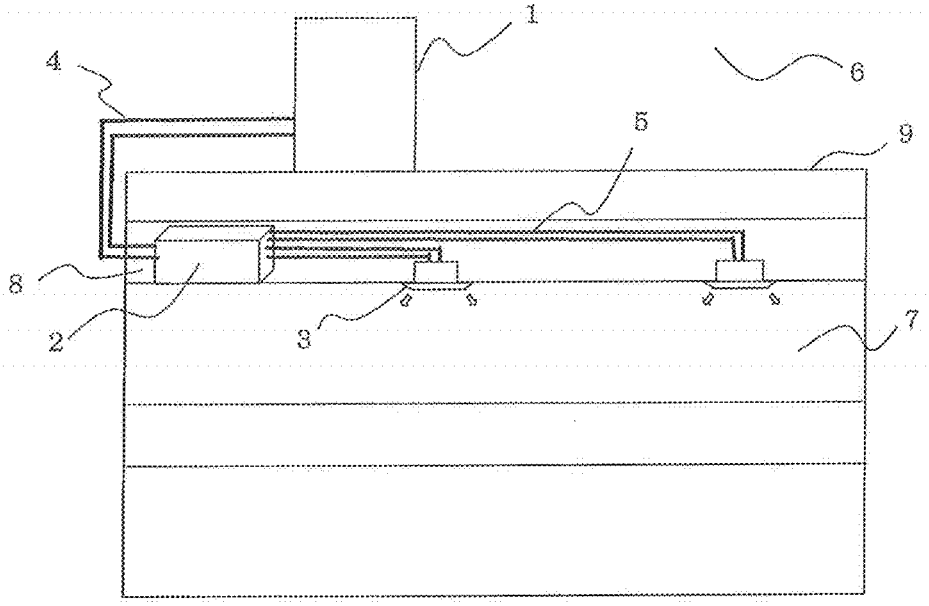
FIG. 1 is a schematic diagram illustrating an example of installation of an air-conditioning apparatus according to Embodiment of the present invention.

FIG. 1 is a schematic diagram illustrating an example of installation of an air-conditioning apparatus according to Embodiment of the present invention. The example of installation of the air-conditioning apparatus will be described with reference to FIG. 1. The air-conditioning apparatus uses a refrigeration cycle (a refrigerant circuit A and a heat medium circuit B), through which refrigerants (a heat source side refrigerant and a heat medium) are circulated, to permit each indoor unit to freely select a cooling mode or a heating mode as an operation mode. FIG. 1 schematically illustrates the entire air-conditioning apparatus including a plurality of indoor units 3 connected. Note that the dimensional relationship among components in FIG. 1 and the following figures may be different from the actual one.

In FIG. 1, the air-conditioning apparatus according to Embodiment includes an outdoor unit (heat source unit) 1, a plurality of indoor units 3, and a single relay unit 2 disposed between the outdoor unit 1 and the indoor units 3. The relay unit 2 exchanges heat between the heat source side refrigerant and the heat medium. The outdoor unit 1 is connected to the relay unit 2 by refrigerant pipes 4 through which the heat source side refrigerant flows. The relay unit 2 is connected to each indoor unit 3 by pipes (heat medium pipes) 5 through which the heat medium flows. Cooling energy or heating energy produced in the outdoor unit 1 is delivered via the relay unit 2 to the indoor units 3.

The outdoor unit 1 is typically disposed in an outdoor space 6 that is a space (e.g., a roof) outside a structure 9, such as a building. The outdoor unit 1 supplies cooling energy or heating energy through the relay unit 2 to the indoor units 3. Each indoor unit 3 is disposed at a position where the indoor unit 3 can supply cooling air or heating air to an indoor space 7 that is a space (e.g., a living room) inside the structure 9. The indoor unit 3 supplies the cooling air or heating air to the indoor space 7, serving as an air-conditioned space. The relay unit 2 includes a housing that is separate from housings of the outdoor unit 1 and the indoor units 3 such that the relay unit 2 can be disposed at a position separate from the outdoor space 6 and the indoor space 7. The relay unit 2 is connected to the outdoor unit 1 by the refrigerant pipes 4 and is connected to the indoor units 3 by the pipes 5 to transfer cooling energy or heating energy, supplied from the outdoor unit 1, to the indoor units 3.

Operations of the air-conditioning apparatus according to Embodiment of the present invention will now be briefly described.

The heat source side refrigerant is conveyed from the outdoor unit 1 to the relay unit 2 through the refrigerant pipes 4. The conveyed heat source side refrigerant exchanges heat with the heat medium in an intermediate heat exchanger (intermediate heat exchanger 25 which will be described later) included in the relay unit 2, thus heating or cooling the heat medium. In other words, the intermediate heat exchanger produces hot water or cold water. The hot water or cold water produced in the relay unit 2 is conveyed by a heat medium sending device (pump 31 which will be described later) to the indoor units 3 through the pipes 5. In each indoor unit 3, the hot water or cold water is used in a heating operation (any operation mode that requires hot water) or a cooling operation (any operation mode that requires cold water) for the indoor space 7.

As regards the heat source side refrigerant, for example, a single refrigerant, such as R-22 or R-134a, a near-azeotropic refrigerant mixture, such as R-410A or R-404A, a non-azeotropic refrigerant mixture, such as R-407C, a kind of refrigerant that contains a double bond in its chemical formula and has a relatively low global warming potential, such as $CF_3CF{=}CH_2$, a mixture containing the refrigerant, or a natural refrigerant, such as $CO_2$ or propane, can be used.

As regards the heat medium, for example, water, antifreeze, a mixed solution of water and antifreeze, or a mixed solution of water and an additive with a high corrosion protection effect can be used.

Referring to FIG. 1, the air-conditioning apparatus according to Embodiment is configured such that the outdoor unit 1 is connected to the relay unit 2 with two refrigerant pipes 4 and the relay unit 2 is connected to each indoor unit 3 with two pipes 5. As described above, in the air-conditioning apparatus according to Embodiment, each of the units (the outdoor unit 1, the indoor units 3, and the relay unit 2) is connected with two pipes (the refrigerant pipes 4 or the pipes 5), thus facilitating construction.

FIG. 1 illustrates a state where the relay unit 2 is disposed in a space different from the indoor space 7, for example, a space above a ceiling (hereinafter, simply referred to as a "space 8"), inside the structure 9. The relay unit 2, therefore, may be disposed in a space other than the space above the ceiling, that is, in any place that excludes a living space and allows airflow to/from the outdoor space in any manner. For example, the relay unit 2 can be disposed in a common space in which an elevator or the like is installed and which allows airflow to/from the outdoor space. The relay unit 2 may be disposed near the outdoor unit 1. If the distance between the relay unit 2 and each indoor unit 3 is too long, conveyance power for the heat medium would be significantly large. Note that the effect of energy saving is reduced in this case.

Although FIG. 1 illustrates the case where the outdoor unit 1 is placed in the outdoor space 6, the placement is not limited to this case. For example, the outdoor unit 1 may be placed in an enclosed space, for example, a machine room with a ventilation opening. The outdoor unit 1 may be disposed inside the structure 9 as long as waste heat can be exhausted through an exhaust duct to the outside of the structure 9. Alternatively, the indoor unit 1 of a water-cooled type may be used and be disposed inside the structure 9. If the outdoor unit 1 is disposed in such a place, no problem in particular will occur.

Although FIG. 1 illustrates a case where the indoor units 3 are of a ceiling cassette type, the indoor units are not limited to this type and may be of any type, such as a ceiling concealed type or a ceiling suspended type, capable of supplying heating air or cooling air to the indoor space 7 directly or through a duct or the like.

The number of outdoor units 1, the number of indoor units 3, and the number of relay units 2 which are connected are not limited to the numbers illustrated in FIG. 1. The numbers may be determined depending on the structure 9 where the air-conditioning apparatus according to Embodiment is installed.

In an arrangement of a plurality of relay units 2 connected to the single outdoor unit 1, the relay units 2 can be distributed in, for example, a common space or a space above a ceiling in a structure, such as a building. This enables the intermediate heat exchanger in each relay unit 2 to cover an air conditioning load. Furthermore, each indoor unit 3 can be disposed at a position or level within a range in which the heat medium can be sent by the heat medium sending device in each relay unit 2. Consequently, the indoor units 3 can be arranged in the whole of the structure, such as a building.

Figure 2:
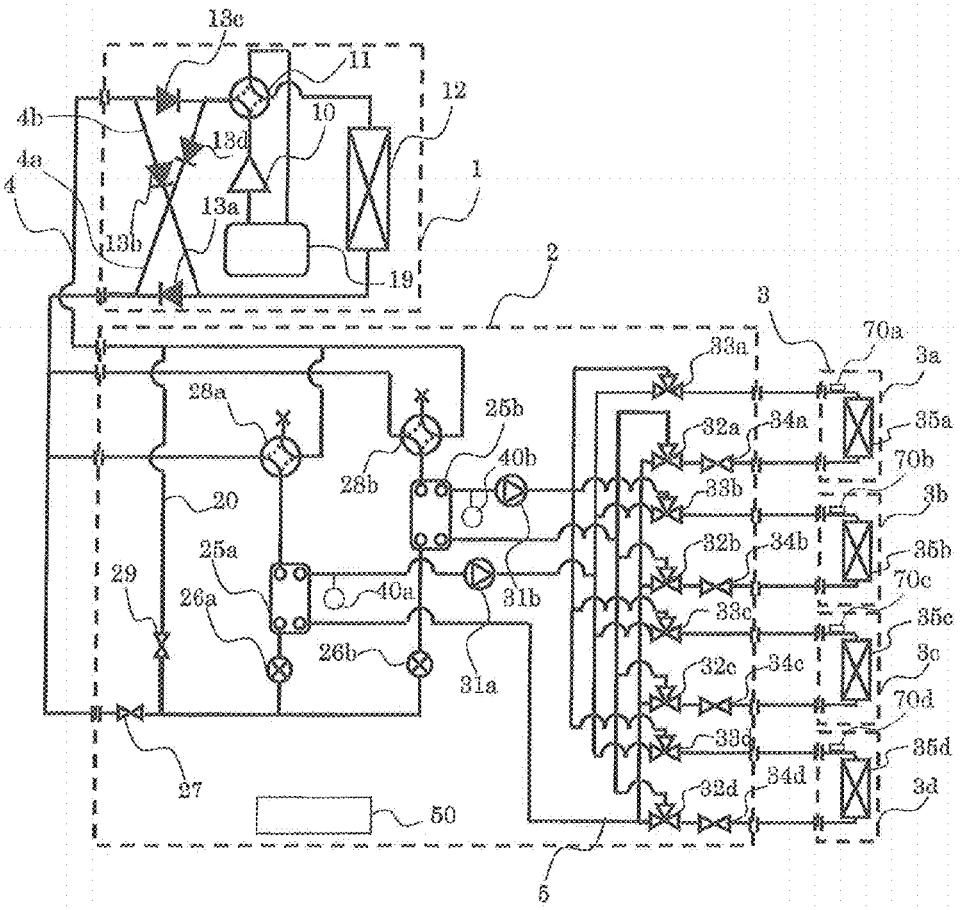
FIG. 2 is a schematic circuit diagram illustrating an exemplary circuit configuration of the air-conditioning apparatus according to Embodiment of the present invention.

FIG. 2 is a schematic circuit diagram illustrating an exemplary circuit configuration of the air-conditioning apparatus (hereinafter, referred to as the "air-conditioning apparatus 100") according to Embodiment. The configuration of the air-conditioning apparatus 100, that is, functions of actuators included in the refrigerant circuit will now be described in detail with reference to FIG. 2. Referring to FIG. 2, the outdoor unit 1 is connected to the relay unit 2 by the refrigerant pipes 4 through an intermediate heat exchanger (refrigerant-water heat exchanger) 25*a* and an intermediate heat exchanger (refrigerant-water heat exchanger) 25*b* included in the relay unit 2. The relay unit 2 is connected to each indoor unit 3 by the pipes 5 through the intermediate heat exchangers 25*a* and 25*b*. The refrigerant pipes 4 and the pipes 5 will be described in detail later.

[Outdoor Unit 1]

The outdoor unit 1 includes a compressor 10, a first refrigerant flow switching device 11, such as a four-way valve, a heat source side heat exchanger 12, and an accumulator 19 which are connected in series by the refrigerant pipes 4. The outdoor unit 1 further includes a refrigerant connecting pipe 4*a*, a refrigerant connecting pipe 4*b*, a check valve 13*a*, a check valve 13*b*, a check valve 13*c*, and a check valve 13*d*. Such an arrangement of the refrigerant connecting pipes 4*a* and 4*b* and the check valves 13*a*, 13*b*, 13*c*, and 13*d* enables the heat source side refrigerant, flowing into the relay unit 2, to flow in a constant direction irrespective of an operation requested by any indoor unit 3.

The compressor 10 sucks the heat source side refrigerant, compresses the heat source side refrigerant to a high-temperature high-pressure state, and discharges the heat source side refrigerant to circulate the refrigerant through the refrigerant circuit A. The compressor 10 may be a capacity-controllable inverter compressor, for example. The first refrigerant flow switching device 11 switches between a flow direction of the heat source side refrigerant in a heating operation (including a heating only operation mode and a heating main operation mode) and that in a cooling operation (including a cooling only operation mode and a cooling main operation mode).

The heat source side heat exchanger 12 functions as an evaporator in the heating operation and functions as a condenser (or a radiator) in the cooling operation to exchange heat between the heat source side refrigerant and fluid, such as air, supplied from an air-sending device (not illustrated), for example, a fan, such that the heat source side refrigerant evaporates and gasifies or condenses and liquefies. The accumulator 19, which is disposed on a suction side of the compressor 10, stores an excess of refrigerant caused by the difference between the heating operation and the cooling operation or an excess of refrigerant caused by a transient change in operation.

The check valve 13*c*, which is disposed to the refrigerant pipe 4 located between the relay unit 2 and the first refrigerant flow switching device 11, permits the heat source side refrigerant to flow only in a predetermined direction (the direction from the relay unit 2 to the outdoor unit 1). The check valve 13*a*, which is disposed to the refrigerant pipe 4 located between the heat source side heat exchanger 12 and the relay unit 2, permits the heat source side refrigerant to flow only in a predetermined direction (the direction from the outdoor unit 1 to the relay unit 2). The check valve 13*d*, which is disposed to the refrigerant connecting pipe 4*a*, allows the heat source side refrigerant discharged from the compressor 10 in the heating operation to flow to the relay unit 2. The check valve 13*b*, which is disposed to the refrigerant connecting pipe 4*b*, allows the heat source side refrigerant returned from the relay unit 2 in the heating operation to flow to the suction side of the compressor 10.

The refrigerant connecting pipe 4*a* connects the refrigerant pipe 4 located between the first refrigerant flow switching device 11 and the check valve 13*c* to the refrigerant pipe 4 located between the check valve 13*a* and the relay unit 2 in the outdoor unit 1. The refrigerant connecting pipe 4*b* connects the refrigerant pipe 4 located between the check valve 13*c* and the relay unit 2 to the refrigerant pipe 4 located between the heat source side heat exchanger 12 and the check valve 13*a* in the outdoor unit 1. Although FIG. 2 illustrates the case where the refrigerant connecting pipes 4*a* and 4*b* and the check valves 13*a*, 13*b*, 13*c*, and 13*d* are arranged, the configuration is not limited to this case. The air-conditioning apparatus 100 does not necessarily have to include those components.

[Indoor Units 3]

The indoor units 3 each include a use side heat exchanger 35. This use side heat exchanger 35 is connected by the pipes 5 to a heat medium flow rate control device 34 and a second heat medium flow switching device 33 arranged in the relay unit 2. Each use side heat exchangers 35*a*, 35*b*, 35*c* and 35*d* exchanges heat between the heat medium and air supplied from an air-sending device 36*a*, 36*b*, 36*c* and 36*d* (only shown in FIG. 3 but not illustrated in other figures), for example, a fan, to produce heating air or cooling air to be supplied to the indoor space 7.

The indoor units 3 each further include a temperature sensor 70 (70*a* to 70*d*) for detecting a temperature of the heat medium on an inlet side of the use side heat exchanger 35 connected to the relay unit 2 by the pipes 5. Information detected by the temperature sensors 70 is transmitted to a controller 50 that controls an operation of the air-conditioning apparatus 100 in a centralized manner, and is used to control, for example, a driving frequency of the compressor 10, a rotation speed of each air-sending device (not illustrated), 20 switching by the first refrigerant flow switching device 11, a driving frequency of the pumps 31, switching by second refrigerant flow switching devices 28, and switching between passages for the heat medium, a flow rate of the heat medium through each indoor unit 3, and switching between operations of the air-sending device (e.g., 36*a*, 36*b*, 36*c* and 36*d* in FIG. 3) in the indoor unit 3.

FIG. 2 illustrates a case where four indoor units 3 are connected to the relay unit 2. An indoor unit 3*a*, an indoor unit 3*b*, an indoor unit 3*c*, and an indoor unit 3*d* are illustrated in that order from the top in FIG. 2. In addition, the use side heat exchangers 35 are illustrated as a use side heat exchanger 35*a*, a use side heat exchanger 35*b*, a use side heat exchanger 35*c*, and a use side heat exchanger 35*d* in that order from the top in FIG. 2 so as to correspond to the indoor units 3*a* to 3*d*, respectively. The number of indoor units 3 connected is not limited to four as illustrated in FIG. 1.

[Relay Unit 2]

The relay unit 2 includes at least two intermediate heat exchangers 25, two expansion devices 26, two opening and closing devices (an opening and closing device 27 and an opening and closing device 29), two second refrigerant flow switching devices 28, two pumps 31, four first heat medium flow switching devices 32, four second heat medium flow switching devices 33, and four heat medium flow rate control devices 34.

Each of the two intermediate heat exchangers 25 (the intermediate heat exchangers 25*a* and 25*b*) functions as a condenser (radiator) when supplying heating energy to the indoor units 3 performing the heating operation and functions as an evaporator when supplying cooling energy to the indoor units 3 performing the cooling operation, and exchanges heat between the heat source side refrigerant and the heat medium to transfer cooling energy or heating energy, produced by the outdoor unit 1 and stored in the heat source side refrigerant, to the heat medium. The intermediate heat exchanger 25*a* is disposed between an expansion device 26*a* and a second refrigerant flow switching device 28*a* in the refrigerant circuit A and is used to cool the heat medium in a cooling and heating mixed operation mode. The intermediate heat exchanger 25*b* is disposed between an expansion device 26*b* and a second refrigerant flow switching device 28*b* in the refrigerant circuit A and is used to heat the heat medium in the cooling and heating mixed operation mode.

Each of the two expansion devices 26 (the expansion devices 26*a* and 26*b*) has functions of a pressure reducing valve and an expansion valve and depressurizes the heat source side refrigerant to expand the refrigerant. The expansion device 26*a* is disposed upstream of the intermediate heat exchanger 25*a* in the flow direction of the heat source side refrigerant in the cooling operation. The expansion device 26*b* is disposed upstream of the intermediate heat exchanger 25*b* in the flow direction of the heat source side refrigerant in the cooling operation. Each of the two expansion devices 26 may be a component having a variably controllable opening degree, for example, an electronic expansion valve.

Each of the two opening and closing devices (the opening and closing devices 27 and 29) includes, for example, a solenoid valve that can be opened and closed when energized, and opens or closes the refrigerant pipe 4. In other words, opening and closing of the two opening and closing devices are controlled in accordance with an operation mode, thus switching between the passages for the heat source side refrigerant. The opening and closing device 27 is disposed to the refrigerant pipe 4 on an inlet side for the heat source side refrigerant (the refrigerant pipe 4 closest to the bottom in FIG. 2 of the refrigerant pipes 4 connecting the outdoor unit 1 and the relay unit 2). The opening and closing device 29 is disposed to a pipe (bypass pipe 20) connecting the refrigerant pipe 4 on the inlet side for the heat source side refrigerant and the refrigerant pipe 4 on an outlet side therefore. Each of the opening and closing devices 27 and 29 may be a component capable of switching between refrigerant passages, for example, a component having a variably controllable opening degree, such as an electronic expansion valve.

Each of the two second refrigerant flow switching devices 28 (the second refrigerant flow switching devices 28*a* and 28*b*) includes a four-way valve and switches between flow directions of the heat source side refrigerant so that the intermediate heat exchanger 25 functions as a condenser or an evaporator in accordance with an operation mode. The second refrigerant flow switching device 28*a* is disposed downstream of the intermediate heat exchanger 25*a* in the flow direction of the heat source side refrigerant in the cooling operation. The second refrigerant flow switching device 28*b* is disposed downstream of the intermediate heat exchanger 25*b* in the flow direction of the heat source side refrigerant in the cooling only operation mode.

The two pumps 31 (a pump 31*a* and a pump 31*b*) each allow the heat medium flowing through the pipes 5 to be circulated through the heat medium circuit B. The pump 31*a* is disposed to the pipe 5 located between the intermediate heat exchanger 25*a* and the second heat medium flow switching devices 33. The pump 31*b* is disposed to the pipe 5 located between the intermediate heat exchanger 25*b* and the second heat medium flow switching devices 33. Each of the two pumps 31 may be, for example, a capacity-controllable pump. It is preferred that a flow rate through the pump can be controlled depending on the magnitude of a load on the indoor units 3.

Each of the four first heat medium flow switching devices 32 (first heat medium flow switching devices 32*a* to 32*d*) includes a three-way valve and switches between a heat medium passage to the intermediate heat exchanger 25*a* and a heat medium passage to the intermediate heat exchanger 25*b*. The first heat medium flow switching devices 32 whose number (four in this case) corresponds to the number of indoor units 3 installed are arranged. Each first heat medium flow switching device 32 is disposed on an outlet side of a heat medium passage of the corresponding use side heat exchanger 35 such that one of the three ways is connected to the intermediate heat exchanger 25*a*, another one of the three ways is connected to the intermediate heat exchanger 25*b*, and the other one of the three ways is connected to the heat medium flow rate control device 34. The first heat medium flow switching device 32*a*, the first heat medium flow switching device 32*b*, the first heat medium flow switching device 32*c*, and the first heat medium flow switching device 32*d* are illustrated in that order from the top in FIG. 2 so as to correspond to the indoor units 3. Switching between the heat medium passages includes not only full switching from one passage to the other passage but also partial switching from one passage to the other passage.

Each of the four second heat medium flow switching devices 33 (second heat medium flow switching devices 33*a* to 33*d*) includes a three-way valve and switches between a heat medium passage connected to the intermediate heat exchanger 25*a* and a heat medium passage connected to the intermediate heat exchanger 25*b*. The second heat medium flow switching devices 33 whose number (four in this case) corresponds to the number of indoor units 3 installed are arranged. Each second heat medium flow switching device 33 is disposed on an inlet side of the heat medium passage of the corresponding use side heat exchanger 35 such that one of the three ways is connected to the intermediate heat exchanger 25*a*, another one of the three ways is connected to the intermediate heat exchanger 25*b*, and the other one of the three ways is connected to the use side heat exchanger 35. The second heat medium flow switching device 33*a*, the second heat medium flow switching device 33*b*, the second heat medium flow switching device 33*c*, and the second heat medium flow switching device 33*d* are illustrated in that order from the top in FIG. 2 so as to correspond to the indoor units 3. Switching between the heat medium passages includes not only full switching from one passage to the other passage but also partial switching from one passage to the other passage.

Each of the four heat medium flow rate control devices 34 (heat medium flow rate control devices 34*a* to 34*d*) includes a two-way valve capable of controlling the opening area and controls the flow rate of the heat medium flowing through the pipe 5. The heat medium flow rate control devices 34 whose number (four in this case) corresponds to the number of indoor units 3 installed are arranged. Each heat medium flow rate control device 34 is disposed on the outlet side of the heat medium passage of the corresponding use side heat exchanger 35 such that one way is connected to the use side heat exchanger 35 and the other way is connected to the first heat medium flow switching device 32. Specifically, the heat medium flow rate control device 34 controls the amount of the heat medium flowing into the indoor unit 3 in accordance with a temperature of the heat medium flowing into the indoor unit 3 and a temperature of the heat medium flowing out of the indoor unit 3 so that an optimum amount of heat medium depending on an indoor load can be supplied to the indoor unit 3.

The heat medium flow rate control device 34*a*, the heat medium flow rate control device 34*b*, the heat medium flow rate control device 34*c*, and the heat medium flow rate control device 34*d* are illustrated in that order from the top in FIG. 2 so as to correspond to the indoor units 3. Each heat medium flow rate control device 34 may be disposed on the inlet side of the heat medium passage of the corresponding use side heat exchanger 35. Furthermore, the heat medium flow rate control device 34 may be disposed on the inlet side of the heat medium passage of the corresponding use side heat exchanger 35 so as to be located between the second heat medium flow switching device 33 and the use side heat exchanger 35. In addition, fully closing the heat medium flow rate control device 34 can stop supply of the heat medium to the corresponding indoor unit 3 if the indoor unit 3 requires no load, for example, the indoor unit 3 is in non-operation or a thermo off state.

If each of the first heat medium flow switching devices 32 and the second heat medium flow switching devices 33 further has functions of the heat medium flow rate control device 34, the heat medium flow rate control devices 34 can be eliminated.

The relay unit 2 further includes temperature sensors 40 (a temperature sensor 40*a* and a temperature sensor 40*b*) for detecting a temperature of the heat medium on an outlet side of the intermediate heat exchanger 25. Information (temperature information) detected by the temperature sensors 40 is transmitted to the controller 50 that controls an operation of the air-conditioning apparatus 100 in a centralized manner and is used to control, for example, the driving frequency of the compressor 10, the rotation speed of each air-sending device (e.g., 36*a*, 36*b*, 36*c* and 36*d* in FIG. 3), switching by the first refrigerant flow switching device 11, the driving frequency of the pumps 31, switching by the second refrigerant flow switching devices 28, switching between the heat medium passages, and a flow rate of the heat medium through each indoor unit 3. Although FIG. 2 illustrates the case where the controller can 50 is disposed in the relay unit 2, the configuration is not limited to the case. The controller 50 may be disposed in the outdoor unit 1 or any of the indoor units 3. Alternatively, the controller 50 may be disposed in each of the outdoor unit 1, the relay unit 2, and the indoor units 3 such that the 5 controllers can communicate with each other.

The controller 50 includes a microcomputer and controls the actuators (or driving parts for, for example, the pumps 31, the first heat medium flow switching devices 32, the second heat medium flow switching devices 33, the expansion devices 26, and the second refrigerant flow switching devices 28) in order to control, for example, the driving frequency of the compressor 10, the rotation speed (including ON/OFF) of each air-sending device, switching by the first refrigerant flow switching device 11, driving of the pumps 31, the opening degree of each expansion device 26, opening and closing of the opening and closing devices, switching by each second refrigerant flow switching device 28, switching by each first heat medium flow switching device 32, switching by each second heat medium flow switching device 33, and driving of the heat medium flow rate control devices 34 on the basis of information detected by individual detecting means and an instruction from a remote control, thus performing any of operation modes, which will be described later, and switching to a heat medium passage to a heat medium heat storage tank.

The pipes 5 through which the heat medium flows include the pipes connected to the intermediate heat exchanger 25*a* and the pipes connected to the intermediate heat exchanger 25*b*. Each pipe 5 branches into pipes (four pipes in this case) equal in number to the indoor units 3 connected to the relay unit 2. The pipes 5 are connected by the first heat medium flow switching devices 32 and the second heat medium flow switching devices 33. Controlling each first heat medium flow switching device 32 and each second heat medium flow switching device 33 determines whether the heat medium flowing from the intermediate heat exchanger 25*a* is allowed to flow into the corresponding use side heat exchanger 35 or the heat medium flowing from the intermediate heat exchanger 25*b* is allowed to flow into the corresponding use side heat exchanger 35.

In the air-conditioning apparatus 100, the compressor 10, the first refrigerant flow switching device 11, the heat source side heat exchanger 12, the opening and closing device 27, the opening and closing device 29, the second refrigerant flow switching devices 28, refrigerant passages of the intermediate heat exchangers 25, the expansion devices 26, and the accumulator 19 are connected by the refrigerant pipes 4, thus forming the refrigerant circuit A. In addition, heat medium passages of the intermediate heat exchangers 25, the pumps 31, the first heat medium flow switching devices 32, the heat medium flow rate control devices 34, the use side heat exchangers 35, and the second heat medium flow switching devices 33 are connected by the pipes 5, thus forming heat medium circuit B. In other words, the use side heat exchangers 35 are connected in parallel with each of the intermediate heat exchangers 25, thus providing the heat medium circuit B as multiple systems.

In the air-conditioning apparatus 100, the outdoor unit 1 and the relay unit 2 are connected through the intermediate heat exchangers 25*a* and 25*b* arranged in the relay unit 2. The relay unit 2 and each indoor unit 3 are also connected through the intermediate heat exchangers 25*a* and 25*b*. In other words, in the air-conditioning apparatus 100, the heat source side refrigerant circulated through the refrigerant circuit A exchanges heat with the heat medium circulated through the heat medium circuit B in each of the intermediate heat exchangers 25*a* and 25*b*. The air-conditioning apparatus 100 with such a configuration achieves an optimum cooling or heating operation depending on an indoor load.

[Operation Modes]

The operation modes performed by the air-conditioning apparatus 100 will now be described. The air-conditioning apparatus 100 enables each indoor unit 3, on the basis of an instruction from the indoor unit 3, to perform a cooling operation or a heating operation. In other words, the air-conditioning apparatus 100 enables all of the indoor units 3 to perform the same operation and also enables the indoor units 3 to perform different operations.

The operation modes performed by the air-conditioning apparatus 100 include the cooling only operation mode in which all of the driving indoor units 3 perform the cooling operation, the heating only operation mode in which all of the driving indoor units 3 perform the heating operation, the cooling main operation mode in which a cooling load is larger than a heating load in the cooling and heating mixed operation mode, and the heating main operation mode in which a heating load is larger than a cooling load in the cooling and heating mixed operation mode.

The operation modes further include a non-operation mode in which all of the devices in the outdoor unit 1, the relay unit 2, and the indoor units 3 are in non-operation and any cooling or heating operation mode is not performed. The flow of the heat source side refrigerant and that of the heat medium in each of the operation modes, which will be described later, the flow of the heat source side refrigerant and that of the heat medium in a case where the non-operation mode is shifted to another operation mode in which any of the indoor units performs the cooling operation or the heating operation, and the flow of the heat source side refrigerant and that of the heat medium in an operation during a transition from one of the cooling only operation mode and the heating only operation mode of the above-described operation modes to the other operation mode will be described.

[Heating Only Operation Mode]

Figure 3:
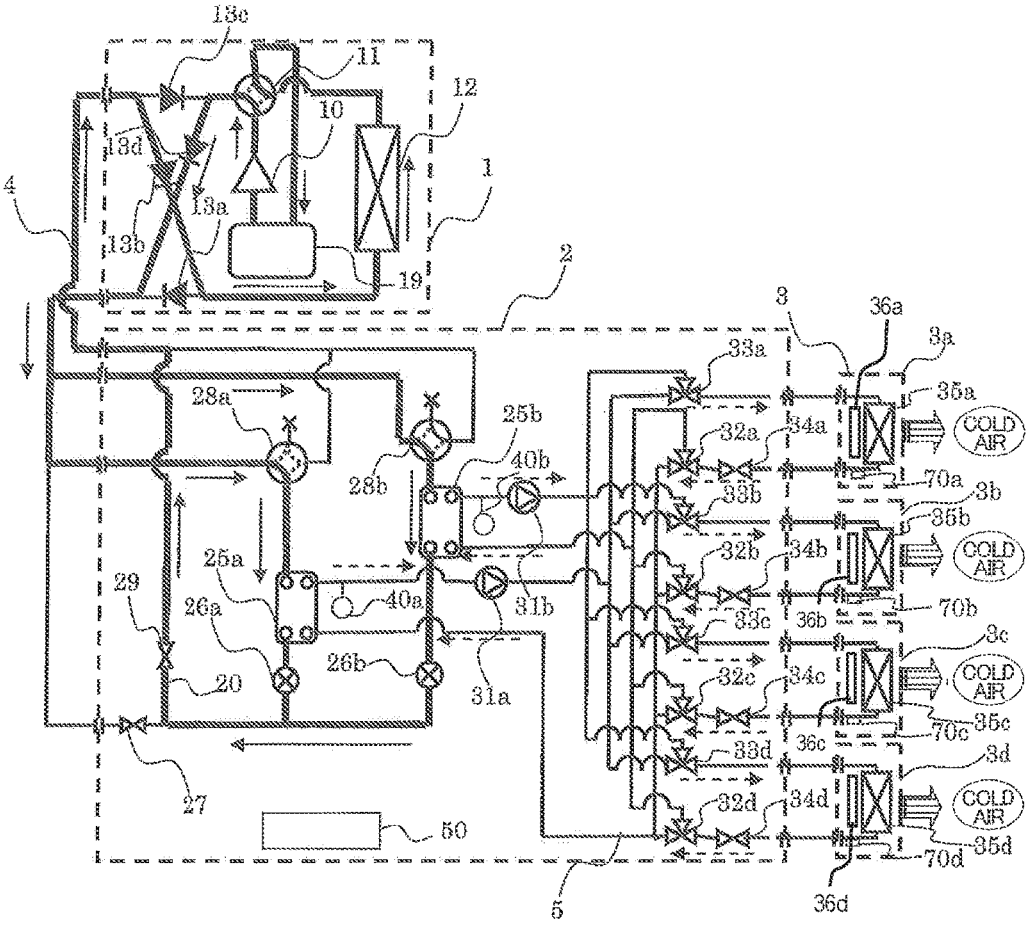
FIG. 3 is a refrigerant circuit diagram illustrating flows of refrigerants in a heating only operation mode of the air-conditioning apparatus according to Embodiment of the present invention.

FIG. 3 is a refrigerant circuit diagram illustrating the flows of the refrigerants in the heating only operation mode of the air-conditioning apparatus 100. The heating only operation mode will be described with respect to a case where a heating load is generated in each of the use side heat exchangers 35*a* to 35*d* in FIG. 3. In FIG. 3, pipes indicated by thick lines correspond to pipes through which the heat source side refrigerant flows. Furthermore, in FIG. 3, solid-line arrows indicate a flow direction of the heat source side refrigerant and broken-line arrows indicate a flow direction of the heat medium.

In the heating only operation mode illustrated in FIG. 3, in the outdoor unit 1, the first refrigerant flow switching device 11 is allowed to perform switching such that the heat source side refrigerant discharged from the compressor 10 flows into the relay unit 2 without passing through the heat source side heat exchanger 12. In the relay unit 2, the pumps 31*a* and 31*b* are driven and the heat medium flow rate control devices 34*a* to 34*d* are opened such that the heat medium is circulated between the intermediate heat exchanger 25*a* and the use side heat exchangers 35*a* to 35*d* and is also circulated between the intermediate heat exchanger 25*b* and the use side heat exchangers 35*a* to 35*d*. The second refrigerant flow switching devices 28*a* and 28*b* are switched to a heating position, the opening and closing device 27 is closed, and the opening and closing device 29 is opened.

First, the flow of the heat source side refrigerant in the refrigerant circuit A will be described.

A low-temperature low-pressure refrigerant is compressed by the compressor 10 and is discharged as a high-temperature high-pressure gas refrigerant from the compressor 10. The high-temperature high-pressure gas refrigerant discharged from the compressor 10 passes through the first refrigerant flow switching device 11, flows through the refrigerant connecting pipe 4*a*, passes through the check valve 13*d*, and flows out of the outdoor unit 1. The high-temperature high-pressure gas refrigerant leaving the outdoor unit 1 passes through the refrigerant pipe 4 and flows into the relay unit 2. The high-temperature high-pressure gas refrigerant to flow into the relay unit 2 is divided into flows and the flows pass through the second refrigerant flow switching devices 28*a* and 28*b* and then enter the intermediate heat exchangers 25*a* and 25*b*.

The high-temperature high-pressure gas refrigerant, which has flowed into the intermediate heat exchanger 25*a* and the intermediate heat exchanger 25*b*, condenses and liquefies while transferring heat to the heat medium circulated through the heat medium circuit B, such that it turns into a high-pressure liquid refrigerant. The liquid refrigerant leaving the intermediate heat exchanger 25*a* and that leaving the intermediate heat exchanger 25*b* are expanded into a low-temperature low-pressure two-phase refrigerant by the expansion device 26*a* and the expansion device 26*b*, respectively. These flows of two-phase refrigerant merge into a single flow of two-phase refrigerant. The two-phase refrigerant then passes through the opening and closing device 29, flows out of the relay unit 2, passes through the refrigerant pipe 4, and again flows into the outdoor unit 1. The refrigerant, which has flowed into the outdoor unit 1, flows through the refrigerant connecting pipe 4*b*, passes through the check valve 13*b*, and flows into the heat source side heat exchanger 12, functioning as an evaporator.

The heat source side refrigerant, which has flowed into the heat source side heat exchanger 12, removes heat from air (hereinafter, referred to as "outdoor air") in the outdoor space 6 in the heat source side heat exchanger 12, such that the refrigerant turns into a low-temperature low-pressure gas refrigerant. The low-temperature low-pressure gas refrigerant leaving the heat source side heat exchanger 12 passes through the first refrigerant flow switching device 11 and the accumulator 19 and is again sucked into the compressor 10.

At this time, the opening degree of each expansion device 26 is controlled to provide a constant subcooling (degree of subcooling). The degree of subcooling is obtained as the difference between a saturation temperature converted from a pressure of the heat source side refrigerant flowing between the expansion device 26 and the corresponding intermediate heat exchanger 25 and a temperature of the refrigerant on the outlet side of the intermediate heat exchanger 25. If a temperature at the middle position of each intermediate heat exchanger 25 can be measured, the temperature at the middle position may be used instead of the saturation temperature. In this case, a pressure sensor can be eliminated, so that such a system can be constructed inexpensively.

Next, the flow of the heat medium in the heat medium circuit B will be described.

In the heating only operation mode, both the intermediate heat exchanger 25*a* and the intermediate heat exchanger 25*b* transfer heating energy of the heat source side refrigerant to the heat medium and the pumps 31*a* and 31*b* allow the heated heat medium to flow through the pipes 5. The heat medium, which has flowed out of each of the pumps 31*a* and 31*b* while being pressurized, flows through the second heat medium flow switching devices 33*a* to 33*d* into the use side heat exchangers 35*a* to 35*d*. The heat medium transfers heat to indoor air in each of the use side heat exchangers 35*a* to 35*d*, thus heating the indoor space 7.

Then, the heat medium flows out of each of the use side heat exchangers 35*a* to 35*d* and flows into the corresponding one of the heat medium flow rate control devices 34*a* to 34*d*. At this time, each of the heat medium flow rate control devices 34*a* to 34*d* allows the heat medium to be controlled at a flow rate necessary to cover an air conditioning load required in the indoor space, such that the controlled flow rate of heat medium flows into the corresponding one of the use side heat exchangers 35*a* to 35*d*. The heat medium leaving the heat medium flow rate control devices 34*a* to 34*d* passes through the first heat medium flow switching devices 32*a* to 32*d*, flows into the intermediate heat exchangers 25*a* and 25*b*, receives heat from the refrigerant by an amount equivalent to the amount of heat supplied to the indoor spaces 7 through the indoor units 3, and is then again sucked into the pumps 31*a* and 31*b*.

In the pipe 5 in each use side heat exchanger 35, the heat medium flows in the direction in which the heat medium flows from the second heat medium flow switching device 33 through the heat medium flow rate control device 34 to the first heat medium flow switching device 32. Furthermore, the difference between a temperature detected by the temperature sensor 40*a* or that detected by the temperature sensor 40*b* and a temperature of the heat medium leaving each use side heat exchanger 35 is controlled such that the difference is held at a target value, so that the air conditioning load required in the indoor space 7 can be covered. As regards a temperature on the outlet side of each intermediate heat exchanger 25, either of the temperature detected by the temperature sensor 40*a* and that detected by the temperature sensor 40*b* may be used. Alternatively, the mean temperature of them may be used.

At this time, the first heat medium flow switching devices 32 and the second heat medium flow switching devices 33 are controlled at an intermediate opening degree or an opening degree depending on a temperature of the heat medium at the outlet of the intermediate heat exchanger 25*a* and a temperature of the heat medium at the outlet of the intermediate heat exchanger 25*b* so that passages to both the intermediate heat exchanger 25*a* and the intermediate heat exchanger 25*b* are established. Each use side heat exchanger 35 should be controlled on the basis of the difference between a temperature at the inlet of the use side heat exchanger 35 and that at the outlet thereof. A temperature of the heat medium on the inlet side of the use side heat exchanger 35 is substantially the same as a temperature detected by the temperature sensor 40*b* and the use of the temperature sensor 40*b* results in a reduction in the number of temperature sensors. Thus, the system can be constructed inexpensively.

In performing the heating only operation mode, it is unnecessary to supply the heat medium to each use side heat exchanger 35 having no thermal load (including being in the thermo off state). Accordingly, the corresponding heat medium flow rate control device 34 is closed to block the passage so that the heat medium does not flow into the use side heat exchanger 35. In FIG. 3, the use side heat exchangers 35*a* to 35*d* each have a thermal load and the heat medium is allowed to flow to each of the use side heat exchangers 35*a* to 35*d*. If any use side heat exchanger 35 has no thermal load, the corresponding heat medium flow rate control device 34 may be fully closed. When a thermal load is again generated, the corresponding heat medium flow rate control device 34 may be opened such that the heat medium is circulated. The same applies to the other operation modes which will be described later.

[Cooling Only Operation Mode]

Figure 4:
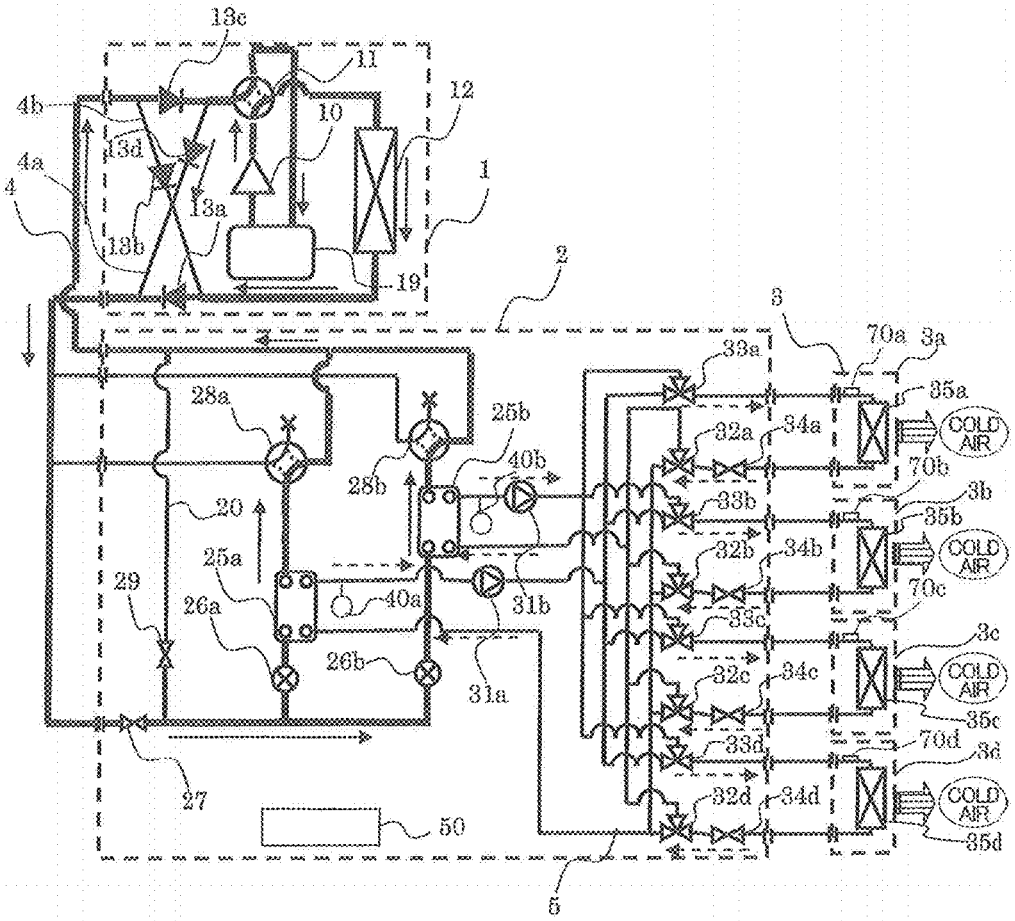
FIG. 4 is a refrigerant circuit diagram illustrating flows of the refrigerants in a cooling only operation mode of the air-conditioning apparatus according to Embodiment of the present invention.

FIG. 4 is a refrigerant circuit diagram illustrating the flows of the refrigerants in the cooling only operation mode of the air-conditioning apparatus 100. The cooling only operation mode will be described with respect to a case where a cooling load is generated in each of the use side heat exchangers 35*a* to 35*d* in FIG. 4. In FIG. 4, pipes indicated by thick lines correspond to pipes through which the heat source side refrigerant flows. Furthermore, in FIG. 4, solid-line arrows indicate a flow direction of the heat source side refrigerant and broken-line arrows indicate a flow direction of the heat medium.

In the cooling only operation mode illustrated in FIG. 4, in the outdoor unit 1, the first refrigerant flow switching device 11 is allowed to perform switching such that the heat source side refrigerant discharged from the compressor 10 flows into the heat source side heat exchanger 12.

In the relay unit 2, the pumps 31*a* and 31*b* are driven and the heat medium flow rate control devices 34*a* to 34*d* are opened such that the heat medium is circulated between the intermediate heat exchanger 25*a* and the use side heat exchangers 35*a* to 35*d* and is also circulated between the intermediate heat exchanger 25*b* and the use side heat exchangers 35*a* to 35*d*. The second refrigerant flow switching devices 28*a* and 28*b* are switched to a cooling position, the opening and closing device 27 is opened, and the opening and closing device 29 is closed.

First, the flow of the heat source side refrigerant in the refrigerant circuit A will be described.

A low-temperature low-pressure refrigerant is compressed by the compressor 10 and is discharged as a high-temperature high-pressure gas refrigerant from the compressor 10. The high-temperature high-pressure gas refrigerant discharged from the compressor 10 flows through the first refrigerant flow switching device 11 and passes through the heat source side heat exchanger 12, in which the refrigerant exchanges heat with outdoor air and thus turns into a high-temperature high-pressure liquid or two-phase refrigerant. The refrigerant passes through the check valve 13*a*, flows through the refrigerant connecting pipe 4*a*, and flows out of the outdoor unit 1. The high-temperature high-pressure liquid or two-phase refrigerant leaving the outdoor unit 1 passes through the refrigerant pipe 4 and flows into the relay unit 2.

The high-temperature high-pressure liquid or two-phase refrigerant, which has flowed into the relay unit 2, passes through the opening and closing device 27 and is then divided into flows to the expansion device 26*a* and the expansion device 26*b*, in each of which the refrigerant is expanded into a low-temperature low-pressure two-phase refrigerant. These flows of two-phase refrigerant evaporate and gasify while removing heat from the heat medium circulated through the heat medium circuit B, such that the refrigerant turns into a low-temperature gas refrigerant. The gas refrigerant leaving the intermediate heat exchanger 25*a* and the intermediate heat exchanger 25*b* passes through the second refrigerant flow switching device 28*a* and the second refrigerant flow switching device 28*b*, flows out of the relay unit 2, passes through the refrigerant pipe 4, the check valve 13*c*, the first refrigerant flow switching device 11, and the accumulator 19, and is then again sucked into the compressor 10.

At this time, the opening degree of each expansion device 26 is controlled to provide a constant superheat (degree of superheat). The degree of superheat is obtained as the difference between a saturation temperature converted from a pressure of the heat source side refrigerant flowing between the expansion device 26 and the corresponding intermediate heat exchanger 25 and a temperature on the outlet side of the intermediate heat exchanger 25. If a temperature at the middle position of each intermediate heat exchanger 25 can be measured, the temperature at the middle position may be used instead of the saturation temperature. In this case, the pressure sensor can be eliminated, so that such a system can be constructed inexpensively.

Next, the flow of the heat medium in the heat medium circuit B will be described.

In the cooling only operation mode, both the intermediate heat exchanger 25*a* and the intermediate heat exchanger 25*b* transfer cooling energy of the heat source side refrigerant to the heat medium. The cooled heat medium is pressurized by the pumps 31*a* and 31*b* and then flows out of the pumps 31*a* and 31*b*. The heat medium flows through the second heat medium flow switching devices 33*a* to 33*d* into the use side heat exchangers 35*a* to 35*d*. The heat medium removes heat from indoor air in each of the use side heat exchangers 35*a* to 35*d*, thus cooling the indoor space 7.

Then, the heat medium flows out of each of the use side heat exchangers 35*a* to 35*d* and flows into the corresponding one of the heat medium flow rate control devices 34*a* to 34*d*. At this time, each of the heat medium flow rate control devices 34*a* to 34*d* allows the heat medium to be controlled at a flow rate necessary to cover an air conditioning load required in the indoor space, such that the controlled flow rate of heat medium flows into the corresponding one of the use side heat exchangers 35*a* to 35*d*. The heat medium leaving the heat medium flow rate control devices 34*a* to 34*d* passes through the first heat medium flow switching devices 32*a* to 32*d*, flows into the intermediate heat exchangers 25*a* and 25*b*, transfers heat to the refrigerant by an amount equivalent to the amount of heat removed from the indoor spaces 7 through the indoor units 3, and is then again sucked into the pumps 31*a* and 31*b*.

In the pipe 5 in each use side heat exchanger 35, the heat medium flows in the direction in which the heat medium flows from the second heat medium flow switching device 33 through the heat medium flow rate control device 34 to the first heat medium flow switching device 32. Furthermore, the difference between a temperature detected by the temperature sensor 40*a* or that detected by the temperature sensor 40*b* and a temperature of the heat medium leaving each use side heat exchanger 35 is controlled such that the difference is held at a target value, so that the air conditioning load required in the indoor space 7 can be covered. As regards a temperature on the outlet side of each intermediate heat exchanger 25, either of the temperature detected by the temperature sensor 40*a* and that detected by the temperature sensor 40*b* may be used. Alternatively, the mean temperature of them may be used.

At this time, the first heat medium flow switching devices 32 and the second heat medium flow switching devices 33 are controlled at an intermediate opening degree or an opening degree depending on a temperature of the heat medium at the outlet of the intermediate heat exchanger 25*a* and a temperature of the heat medium at the outlet of the intermediate heat exchanger 25*b* such that the passages to both the intermediate heat exchanger 25*a* and the intermediate heat exchanger 25*b* are established. Each use side heat exchanger 35 should be controlled on the basis of the difference between a temperature of the heat medium at the inlet of the use side heat exchanger 35 and that at the outlet thereof. A temperature of the heat medium on the inlet side of the use side heat exchanger 35 is substantially the same as a temperature detected by the temperature sensor 40*b* and the use of the temperature sensor 40*b* results in a reduction in the number of temperature sensors. Thus, the system can be constructed inexpensively.

[Cooling and Heating Mixed Operation Mode]

Figure 5:
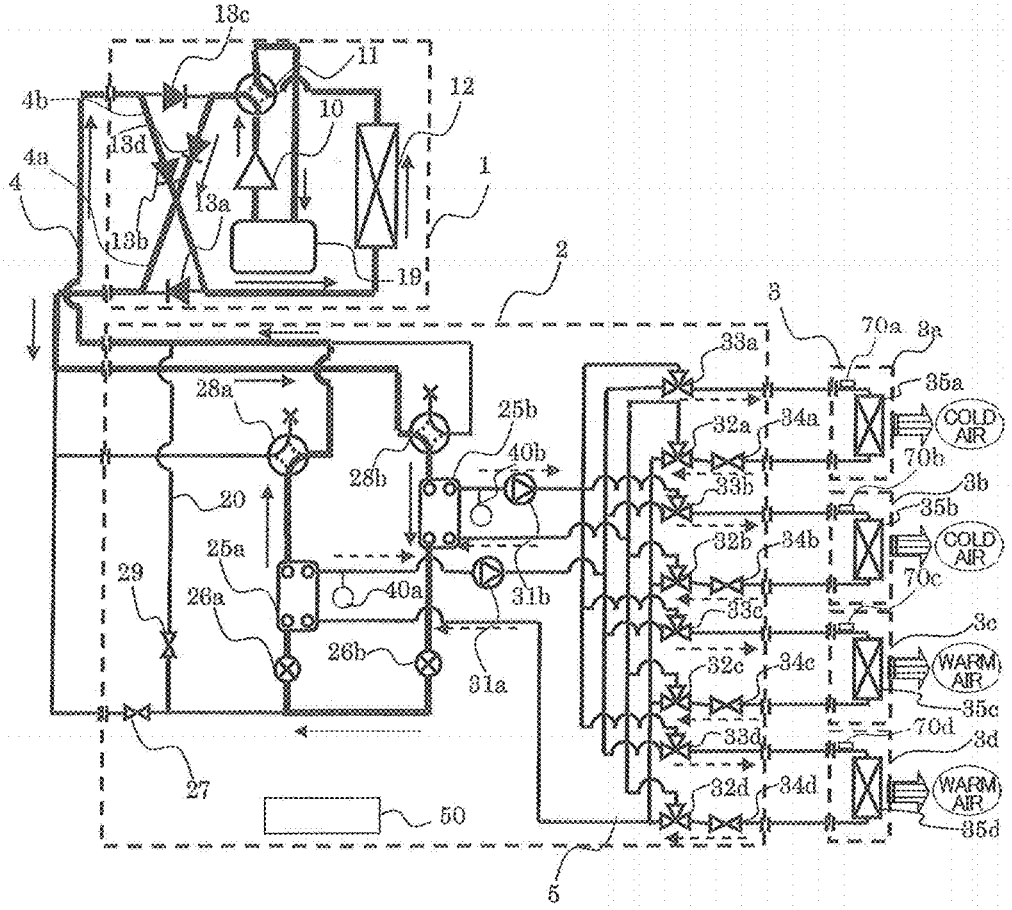
FIG. 5 is a refrigerant circuit diagram illustrating flows of the refrigerants in a cooling and heating mixed operation mode of the air-conditioning apparatus according to Embodiment of the present invention.

FIG. 5 is a refrigerant circuit diagram illustrating the flows of the refrigerants in the cooling and heating mixed operation mode of the air-conditioning apparatus 100. The heating main operation mode will now be described with reference to FIG. 5. The heating main operation mode is included in the cooling and heating mixed operation in which a heating load is generated in any of the use side heat exchangers 35 and a cooling load is generated in the other use side heat exchangers 35. FIG. 5 illustrates a case where the cooling load is generated in the use side heat exchangers 35*a* and 35*b* and the heating load is generated in the use side heat exchangers 35*c* and 35*d*. In FIG. 5, pipes indicated by thick lines correspond to pipes through which the heat source side refrigerant is circulated. Furthermore, in FIG. 5, solid-line arrows indicate a flow direction of the heat source side refrigerant and broken-line arrows indicate a flow direction of the heat medium.

In the heating main operation mode illustrated in FIG. 5, in the outdoor unit 1, the first refrigerant flow switching device 11 is allowed to perform switching such that the heat source side refrigerant discharged from the compressor 10 flows into the relay unit 2 without passing through the heat source side heat exchanger 12. In the relay unit 2, the pumps 31*a* and 31*b* are driven and the heat medium flow rate control devices 34*a* to 34*d* are opened such that the heat medium is circulated between the intermediate heat exchanger 25*a* and the use side heat exchangers 35 in which the cooling load is generated and the heat medium is circulated between the intermediate heat exchanger 25*b* and the use side heat exchangers 35 in which the heating load is generated. The second refrigerant flow switching device 28*a* is switched to the cooling position and the second refrigerant flow switching device 28*b* is switched to the heating position. The expansion device 26*a* is fully opened, the opening and closing device 27 is closed, and the opening and closing device 29 is closed.

First, the flow of the heat source side refrigerant in the refrigerant circuit A will be described.

A low-temperature low-pressure refrigerant is compressed by the compressor 10 and is discharged as a high-temperature high-pressure gas refrigerant from the compressor 10. The high-temperature high-pressure gas refrigerant discharged from the compressor 10 passes through the first refrigerant flow switching device 11, flows through the refrigerant connecting pipe 4*a*, passes through the check valve 13*d*, and flows out of the outdoor unit 1. The high-temperature high-pressure gas refrigerant leaving the outdoor unit 1 passes through the refrigerant pipe 4 and flows into the relay unit 2. The high-temperature high-pressure gas refrigerant, which has flowed into the relay unit 2, passes through the second refrigerant flow switching device 28*b* and flows into the intermediate heat exchanger 25*b*, functioning as a condenser.

The gas refrigerant, which has flowed into the intermediate heat exchanger 25*b*, condenses and liquefies while transferring heat to the heat medium circulated through the heat medium circuit B, such that the refrigerant turns into a liquid refrigerant. The liquid refrigerant leaving the intermediate heat exchanger 25*b* is expanded into a low-pressure two-phase refrigerant by the expansion device 26*b*. This low-pressure two-phase refrigerant flows through the expansion device 26*a* into the intermediate heat exchanger 25*a*, functioning as an evaporator. The low-pressure two-phase refrigerant, which has flowed into the intermediate heat exchanger 25*a*, removes heat from the heat medium circulated through the heat medium circuit B to evaporate, thus cooling the heat medium. This low-pressure two-phase refrigerant flows out of the intermediate heat exchanger 25*a*, passes through the second refrigerant flow switching device 28*a*, flows out of the relay unit 2, passes through the refrigerant pipe 4, and again flows into the outdoor unit 1.

The low-temperature low-pressure two-phase refrigerant, which has flowed into the outdoor unit 1, passes through the check valve 13*b* and flows into the heat source side heat exchanger 12, functioning as an evaporator. The refrigerant, which has flowed into the heat source side heat exchanger 12, removes heat from outdoor air in the heat source side heat exchanger 12, such that the refrigerant turns into a low-temperature low-pressure gas refrigerant. The low-temperature low-pressure gas refrigerant leaving the heat source side heat exchanger 12 flows through the first refrigerant flow switching device 11 and the accumulator 19 and is again sucked into the compressor 10.

The opening degree of the expansion device 26*b* is controlled so that the subcooling (degree of subcooling) related to the refrigerant at the outlet of the intermediate heat exchanger 25*b* reaches a target value. The expansion device 26*b* may be fully opened and the subcooling may be controlled through the expansion device 26*a*.

Next, the flow of the heat medium in the heat medium circuit B will be described.

In the heating main operation mode, the intermediate heat exchanger 25*b* transfers heating energy of the heat source side refrigerant to the heat medium and the pump 31*b* allows the heated heat medium to flow through the pipes 5. Furthermore, in the heating main operation mode, the intermediate heat exchanger 25*a* transfers cooling energy of the heat source side refrigerant to the heat medium and the pump 31*a* allows the cooled heat medium to flow through the pipes 5. The cooled heat medium, which has flowed out of the pump 31*a* while being pressurized, flows into each use side heat exchanger 35 in which the cooling load is generated through the corresponding second heat medium flow switching device 33. The heat medium, which has flowed out of the pump 31*b* while being pressurized, flows into each use side heat exchanger 35 in which the heating load is generated through the corresponding second heat medium flow switching device 33.

In this case, each second heat medium flow switching device 33 connected to the indoor unit 3 in the heating operation mode is switched to the passage connected to the intermediate heat exchanger 25*b* and the pump 31*b*. In addition, each second heat medium flow switching device 33 connected to the indoor unit 3 in the cooling operation mode is switched to the passage connected to the intermediate heat exchanger 25*a* and the pump 31*a*. In other words, the second heat medium flow switching device 33 enables the heat medium to be supplied to the corresponding indoor unit 3 to switch between the heat medium for heating and the heat medium for cooling.

Each use side heat exchanger 35 performs the cooling operation in which the heat medium removes heat from indoor air to cool the indoor space 7 or the heating operation in which the heat medium transfers heat to indoor air to heat the indoor space 7. At this time, the corresponding heat medium flow rate control device 34 allows the heat medium to be controlled at a flow rate necessary to cover an air conditioning load required in the indoor space, such that the controlled flow rate of heat medium flows into the use side heat exchanger 35.

The heat medium used in the cooling operation, which has passed through the use side heat exchangers 35 relevant to the cooling operation and has slightly increased in temperature, passes through the relevant heat medium flow rate control devices 34 and the relevant first heat medium flow switching devices 32, flows into the intermediate heat exchanger 25*a*, and is then again sucked into the pump 31*a*. The heat medium used in the heating operation, which has passed through the use side heat exchangers 35 relevant to the heating operation and has slightly decreased in temperature, passes through the relevant heat medium flow rate control devices 34 and the relevant first heat medium flow switching devices 32, flows into the intermediate heat exchanger 25*b*, and is then again sucked into the pump 31*a*. In this case, each first heat medium flow switching device 32 connected to the indoor unit 3 in the heating operation mode is switched to the passage connected to the intermediate heat exchanger 25*b* and the pump 31*b*. Each first heat medium flow switching device 32 connected to the indoor unit 3 in the cooling operation mode is switched to the passage connected to the intermediate heat exchanger 25*a* and the pump 31*a*.

Throughout this mode, the first heat medium flow switching devices 32 and the second heat medium flow switching devices 33 allow the warm heat medium and the cold heat medium to be supplied to the use side heat exchangers 35 having the heating load and the use side heat exchangers 35 having the cooling load, respectively, without mixing with each other. Consequently, the heat medium used in the heating operation mode is allowed to flow into the intermediate heat exchanger 25*b* in which the refrigerant transfers heat to the heat medium for heating and the heat medium used in the cooling operation mode is allowed to flow into the intermediate heat exchanger 25*a* in which the refrigerant removes heat from the heat medium for cooling. In the intermediate heat exchangers 25, the heat medium exchanges heat with the refrigerant and is then sent to the pumps 31*a* and 31*b*.

In the pipe 5 in each of the use side heat exchangers 35 for heating and those for cooling, the heat medium flows in the direction in which it flows from the second heat medium flow switching device 33 through the heat medium flow rate control device 34 to the first heat medium flow switching device 32. Furthermore, the difference between a temperature detected by the temperature sensor 40*b* and a temperature of the heat medium leaving each use side heat exchanger 35 for heating is controlled such that the difference is held at a target value, so that the air conditioning load required in the indoor space 7 to be heated can be covered. The difference between a temperature detected by the temperature sensor 40*a* and a temperature of the heat medium leaving each use side heat exchanger 35 for cooling is controlled such that the difference is held at a target value, so that the air conditioning load required in the indoor space 7 to be cooled can be covered.

In the cooling main operation mode included in the cooling and heating mixed operation mode of the air-conditioning apparatus 100 of FIG. 5 in which the cooling load is generated in any of the use side heat exchangers 35 and the heating load is generated in the other use side heat exchangers 35, the heat source side refrigerant in the refrigerant circuit A and the heat medium in the heat medium circuit B flow in the same manner as that in the heating main operation mode.

[Non-Operation Mode]

A state in which there is no flow of heat source side refrigerant in the refrigerant circuit A and there is no flow of heat medium in the heat medium circuit B, that is, all of the elements in the refrigerant circuit A and the heat medium circuit B are in non-operation is called the "non-operation mode".

Figure 6:
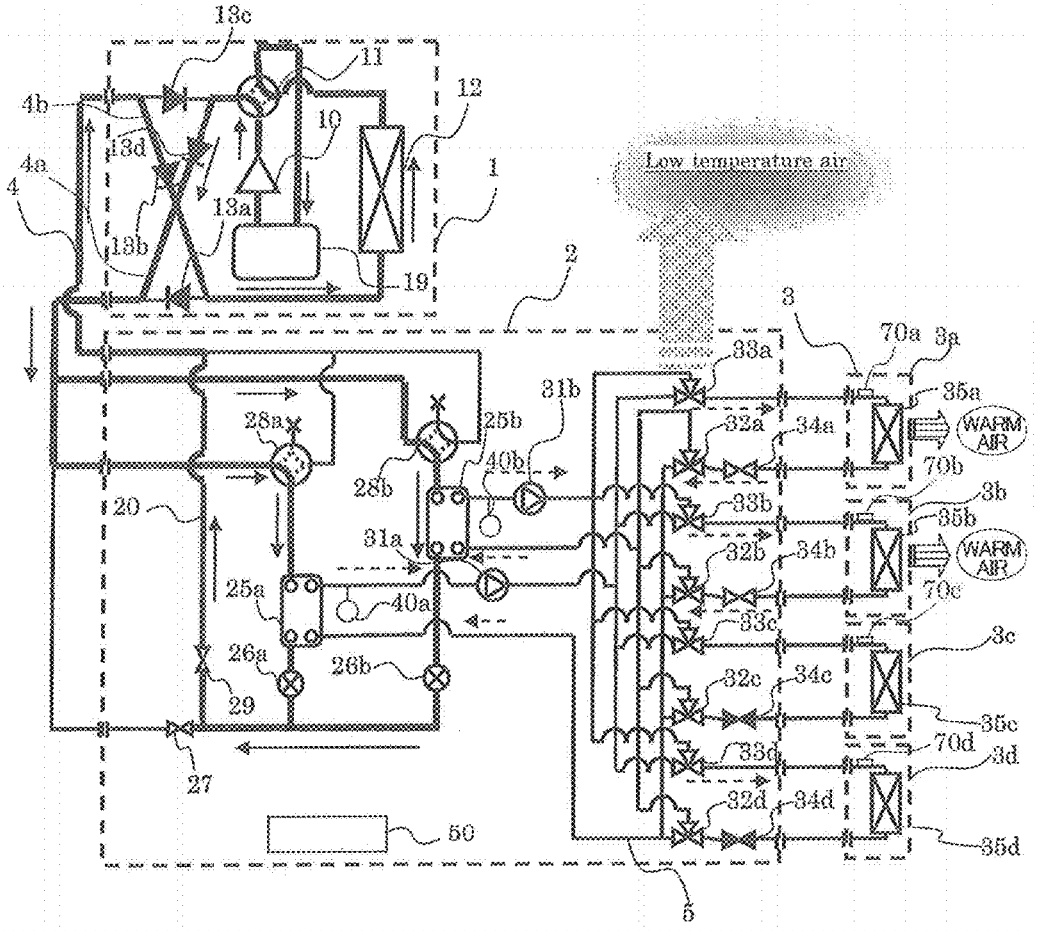
FIG. 6 is a circuit diagram illustrating flow of refrigerant and that of a heat medium upon switching of the air-conditioning apparatus according to Embodiment of the present invention from a non-operation mode to another operation mode in which two indoor units start a heating operation.

FIG. 6 is a circuit diagram illustrating the flow of the refrigerant and that of the heat medium upon switching of the air-conditioning apparatus 100 from the non-operation mode to another operation mode in which two indoor units 3 start the heating operation. FIG. 6 illustrates a case where the use side heat exchangers 35*a* and 35*b* start the heating operation. In FIG. 6, pipes indicated by thick lines correspond to pipes through which the heat source side refrigerant flows. Furthermore, in FIG. 6, solid-line arrows indicate a flow direction of the heat source side refrigerant and broken-line arrows indicate a flow direction of the heat medium.

In the non-operation mode, the heat medium exchanges heat with ambient air through the relay unit 2 and the indoor units 3. As the time elapsed in the non-operation mode is longer, therefore, the temperature of the heat medium is closer to ambient temperature. In particular, in the winter where the ambient temperature is low, the heat medium exchanges heat with the ambient air and accordingly falls to a low temperature. If such a low temperature heat medium is delivered to the indoor units 3 and the indoor units 3 start to send air for a winter heating operation, cold air, that is, lower temperature air than a human body temperature would be supplied to the indoor spaces despite the heating operation. In other words, this would make a user uncomfortable.

Figure 7:
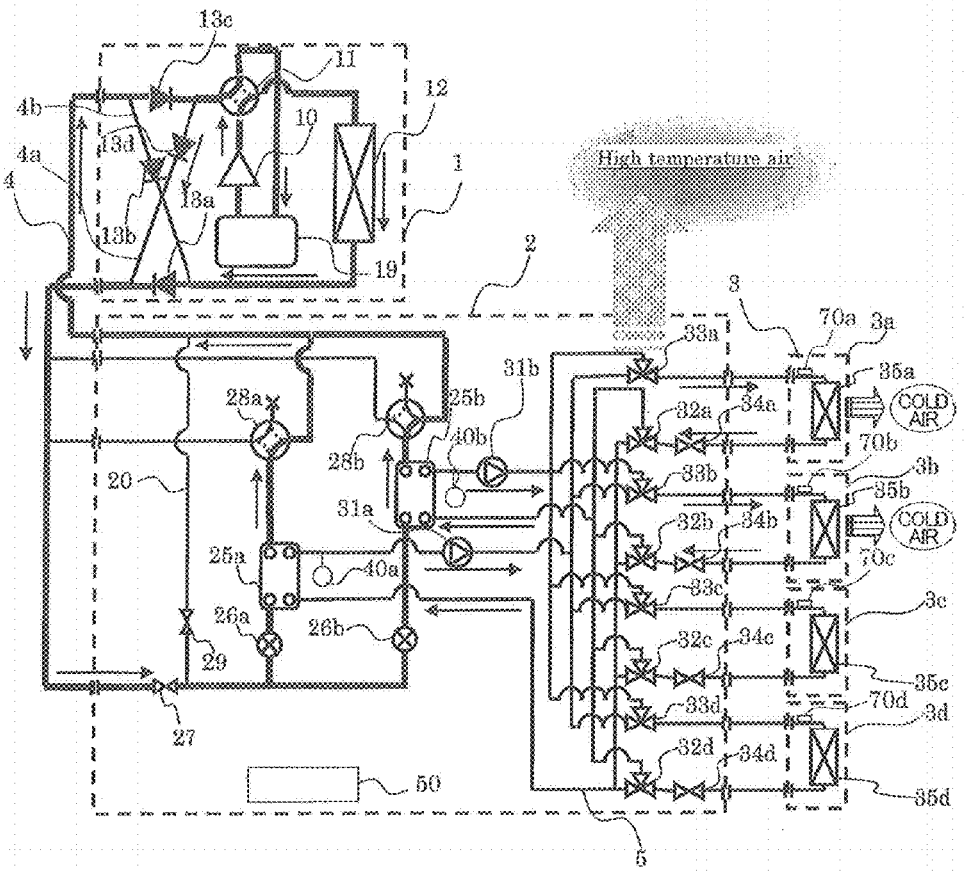
FIG. 7 is a circuit diagram illustrating flow of the refrigerant and that of the heat medium upon switching of the air-conditioning apparatus according to Embodiment of the present invention from the non-operation mode to another operation mode in which two indoor units start a cooling operation.

FIG. 7 is a circuit diagram illustrating the flow of the refrigerant and that of the heat medium upon switching of the air-conditioning apparatus 100 from the non-operation mode to another operation mode in which two indoor units 3 start the cooling operation. FIG. 7 illustrates a case where the use side heat exchangers 35*a* and 35*b* start the cooling operation. In FIG. 7, pipes indicated by thick lines correspond to pipes through which the heat source side refrigerant flows. Furthermore, in FIG. 7, solid-line arrows indicate a flow direction of the heat source side refrigerant and broken-line arrows indicate a flow direction of the heat medium.

As in the case described with reference to FIG. 6, in the summer where ambient temperature is high, the heat medium exchanges heat with the ambient air and accordingly rises to a high temperature. If such a high temperature heat medium is delivered to the indoor units 3 and the indoor units 3 start to send air for a summer cooling operation, warm air, that is, higher temperature air than the human body temperature would be supplied to the indoor spaces despite the cooling operation. In other words, this would make the user uncomfortable.

To avoid supply of a high temperature heat medium in the cooling operation and supply of a low temperature heat medium in the heating operation, the air-conditioning apparatus 100 uses the temperature sensors 70 for detecting a temperature of the heat medium on the inlet side of the use side heat exchanger 35 connected to the relay unit 2 by the pipes 5.

Upon start of the heating operation, each indoor unit 3 which has received a heating operation instruction from the controller 50 allows the corresponding temperature sensor 70 disposed at the inlet of the corresponding use side heat exchanger 35 in the indoor unit 3 to detect a temperature of the heat medium before the indoor unit 3 actuates the air-sending device. When the temperature of the heat medium is lower than 35 degrees C. that is close to the human body temperature, the indoor unit 3 starts the heating operation mode without actuating the air-sending device in the indoor unit 3 (the outdoor unit 1 and the relay unit 2 operate in accordance with such an operation). Then, the indoor unit 3 starts to actuate the air-sending device when a temperature detected by the temperature sensor 70 is successively higher than 35 degrees C., alternatively, after a lapse of five minutes, for example.

On the other hand, upon start of the cooling operation, each indoor unit 3 which has received a cooling operation instruction from the controller 50 allows the corresponding temperature sensor 70 disposed at the inlet of the corresponding use side heat exchanger 35 in the indoor unit 3 to detect a temperature of the heat medium before the indoor unit 3 actuates the air-sending device. When the temperature of the heat medium is higher than 35 degrees C. that is close to the human body temperature, the indoor unit 3 starts the cooling operation mode without actuating the air-sending device in the indoor unit 3 (the outdoor unit 1 and the relay unit 2 operate in accordance with such an operation). Then, the indoor unit 3 starts to actuate the air-sending device when a temperature detected by the temperature sensor 70 is successively lower than 35 degrees C., alternatively, after a lapse of five minutes, for example.

Figure 8:
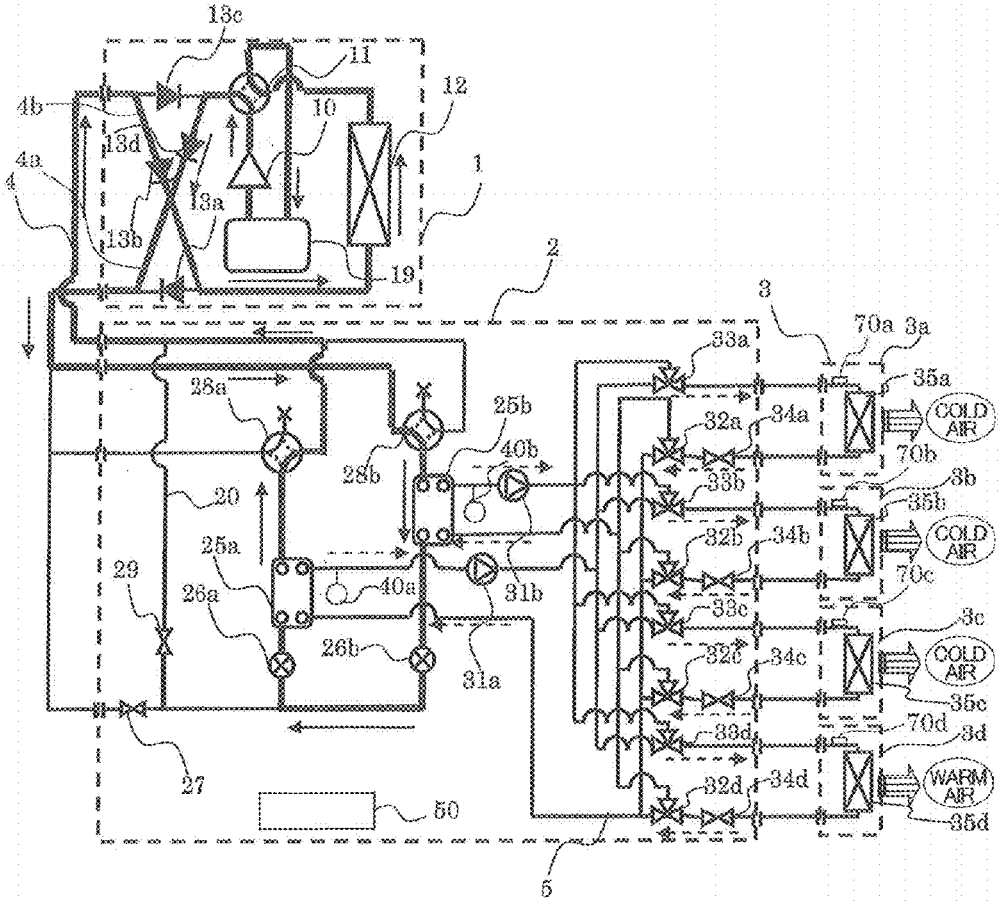
FIG. 8 is a circuit diagram illustrating flow of the refrigerant and that of the heat medium upon switching of the air-conditioning apparatus according to Embodiment of the present invention from the cooling only operation mode to a mixed operation mode in which one of the indoor units connected to a relay unit performs the heating operation.

FIG. 8 is a circuit diagram illustrating the flow of the refrigerant and that of the heat medium upon switching of the air-conditioning apparatus 100 from the cooling only operation mode to the mixed operation mode (the cooling main operation mode) in which one of the indoor units 3 connected to the relay unit 2 performs the heating operation. FIG. 8 illustrates a case where the use side heat exchanger 35*d* has been switched from the cooling operation to the heating operation. In FIG. 8, pipes indicated by thick lines correspond to pipes through which the heat source side refrigerant flows. Furthermore, in FIG. 8, solid-line arrows indicate a flow direction of the heat source side refrigerant and broken-line arrows indicate a flow direction of the heat medium.

In the cooling only operation mode, the heat medium in each heat medium circuit B is cooled to a low temperature by the refrigerant in the refrigerant circuit A. If the low temperature heat medium is conveyed to the indoor unit 3 performing the heating operation and the indoor unit 3 starts to send air, the corresponding indoor space would be supplied with cold air, that is, lower temperature air than the human body temperature despite the heating operation. In other words, this would make the user uncomfortable.

To avoid supply of the low temperature heat medium in the heating operation, the air-conditioning apparatus 100 uses the temperature sensors 70 for detecting a temperature of the heat medium on the inlet side of the use side heat exchanger 35 in the indoor unit 3 connected to the relay unit 2 by the pipes 5.

Upon start of the heating operation, the indoor unit 3 which has received a heating operation instruction from the controller 50 allows the corresponding temperature sensor 70 disposed at the inlet of the corresponding use side heat exchanger 35 in the indoor unit 3 to detect a temperature of the heat medium before the indoor unit 3 actuates the air-sending device. When the temperature of the heat medium is lower than 35 degrees C. that is close to the human body temperature, the indoor unit 3 starts the heating operation mode without actuating the air-sending device in the indoor unit 3 (the outdoor unit 1 and the relay unit 2 operate in accordance with such an operation). Then, the indoor unit 3 starts to actuate the air-sending device when a temperature detected by the temperature sensor 70 is successively higher than 35 degrees C., alternatively, after a lapse of five minutes, for example.

Figure 9:
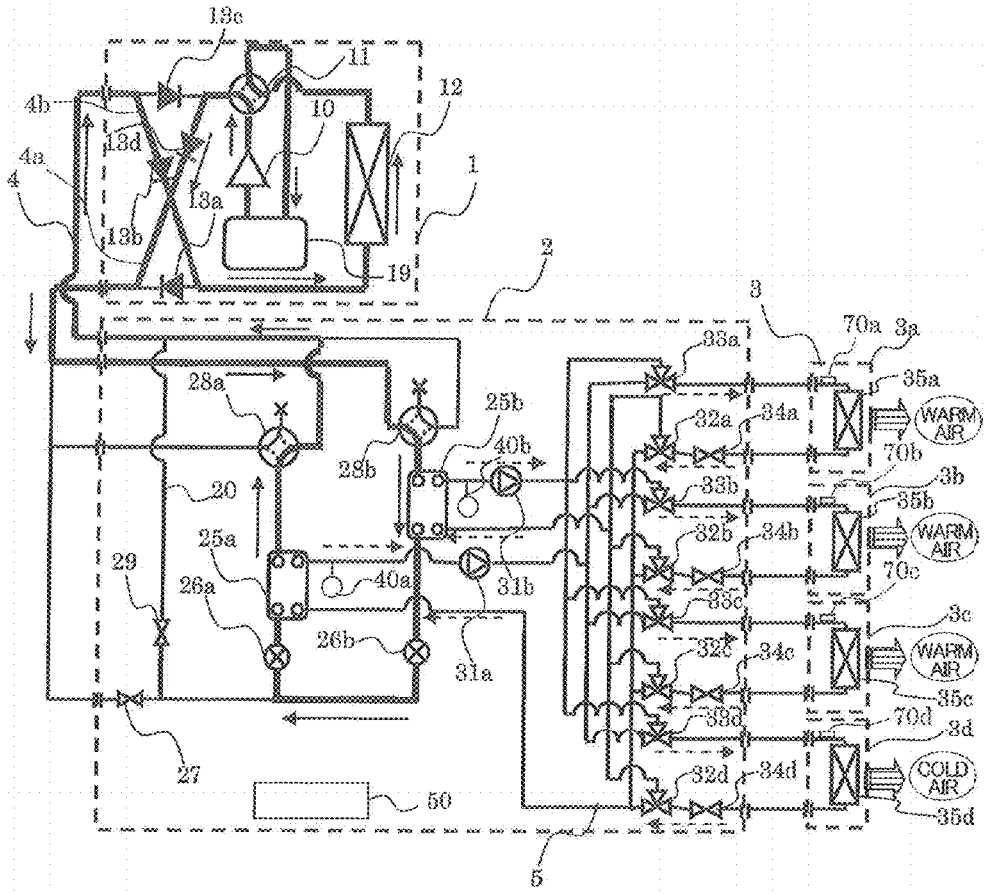
FIG. 9 is a circuit diagram illustrating flow of the refrigerant and that of the heat medium upon switching of the air-conditioning apparatus according to Embodiment of the present invention from the heating only operation mode to a mixed operation mode in which one of the indoor units connected to the relay unit performs the cooling operation.

FIG. 9 is a circuit diagram illustrating the flow of the refrigerant and that of the heat medium upon switching of the air-conditioning apparatus 100 from the heating only operation mode to the mixed operation mode (the heating main operation mode) in which one of the indoor units 3 connected to the relay unit 2 performs the cooling operation. FIG. 9 illustrates a case where the use side heat exchanger 35*d* has been switched from the cooling operation to the heating operation. In FIG. 9, pipes indicated by thick lines correspond to pipes through which the heat source side refrigerant flows. Furthermore, in FIG. 9, solid-line arrows indicate a flow direction of the heat source side refrigerant and broken-line arrows indicate a flow direction of the heat medium.

In the heating only operation mode, the heat medium in each heat medium circuit B is heated to a high temperature by the refrigerant in the refrigerant circuit A. If the high temperature heat medium is conveyed to the indoor unit 3 performing the cooling operation and the indoor unit 3 starts to send air, the corresponding indoor space would be supplied with warm air, that is, higher temperature air than the human body temperature despite the cooling operation. In other words, this would make the user uncomfortable.

To avoid supply of the high temperature heat medium in the cooling operation, the air-conditioning apparatus 100 uses the temperature sensors 70 for detecting a temperature of the heat medium on the inlet side of the use side heat exchanger 35 in the indoor unit 3 connected to the relay unit 2 by the pipes 5.

Upon start of the cooling operation, the indoor unit 3 which has received a cooling operation instruction from the controller 50 allows the corresponding temperature sensor 70 disposed at the inlet of the corresponding use side heat exchanger 35 in the indoor unit 3 to detect a temperature of the heat medium before the indoor unit 3 actuates the air-sending device. When the temperature of the heat medium is higher than 35 degrees C. that is close to the human body temperature, the indoor unit 3 starts the cooling operation mode without actuating the air-sending device in the indoor unit 3 (the outdoor unit 1 and the relay unit 2 operate in accordance with such an operation). Then, the indoor unit 3 starts to actuate the air-sending device when a temperature detected by the temperature sensor 70 is successively lower than 35 degrees C., alternatively, after a lapse of five minutes, for example.

[Example of Control of Air-Sending Device]

The user's comfort may be lost by immediately actuating the air-sending device in the indoor unit 3 upon shifting from the non-operation mode to the cooling operation mode or the heating operation mode and upon switching from one of the cooling only operation mode and the heating only operation mode to the other one.

When the non-operation mode is shifted to the cooling operation mode or the heating operation mode, alternatively, when one of the cooling only operation mode and the heating only operation mode is switched to the other one, the controller 50 does not permit the indoor unit 3 relevant to the shifting or switching to immediately actuate the air-sending device, but allows the air-sending device to be in non-operation until the temperature of the heat medium reaches a predetermined temperature or until a predetermined time has elapsed. When the temperature of the heat medium reaches the predetermined temperature, alternatively, when the predetermined time has elapsed, the controller 50 starts an operation of the air-sending device. For example, an air flow rate through the air-sending device may be controlled to a lower air flow rate (slight airflow) than a predetermined air flow rate for each of the operation modes. After that, the controller 50 may increase the air flow rate and allow the air-sending device to operate at the predetermined air flow rate.

Although the case where the air flow rate is controlled to the slight airflow or a soft airflow upon shifting from the non-operation mode to the cooling operation mode or the heating operation mode or upon switching from one of the cooling only operation mode and the heating only operation mode to the other one and is then gradually increased to the predetermined air flow rate has been described above, Embodiment is not limited to this case. For example, when the heat medium reaches the predetermined temperature, the air-sending device in the indoor unit 3 which has received an instruction to start the heating operation may be allowed to operate at the predetermined air flow rate without being controlled to the slight airflow or the soft airflow.

In the above-described case, 35 degrees C., used as a criterion for temperatures successively detected by the temperature sensor 70, is a typical human body temperature reference. The reference may be set to a temperature other than 35 degrees C. A temperature other than 35 degrees C., for example, 25 degrees C. or 15 degrees C., may be set as a criterion for providing a mild sensation of cold, especially in the cooling operation.

Figure 10:
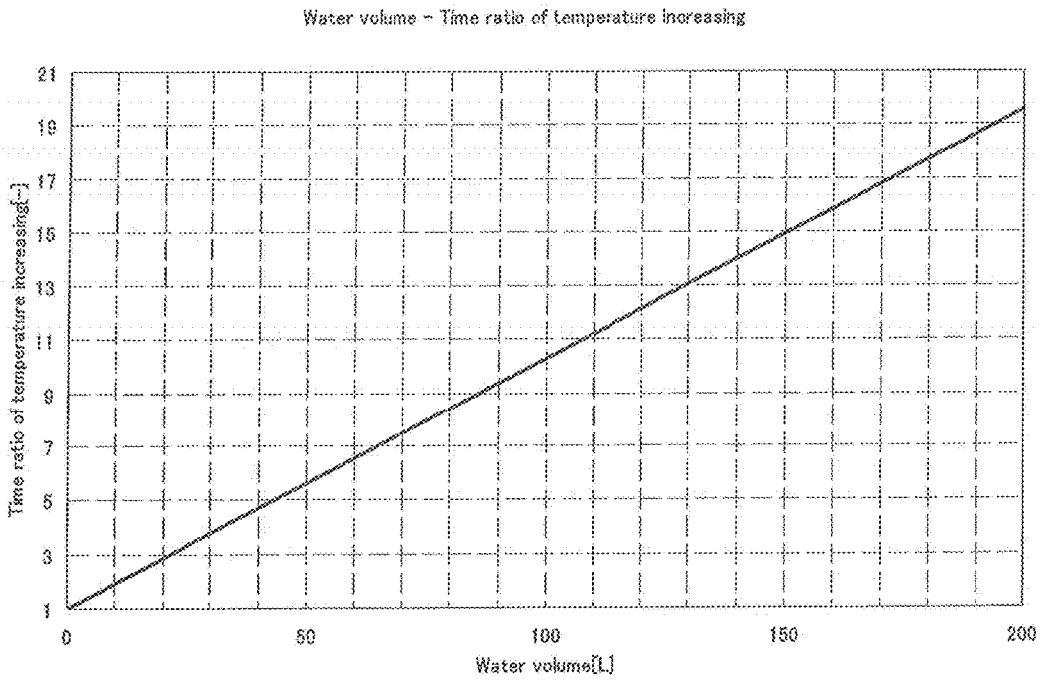
FIG. 10 is a graph illustrating an example of the ratio of temperature rise time of the heat medium to the total volume of the heat medium increased in the heating operation mode.

FIG. 10 illustrates an example of the ratio of temperature rise time of the heat medium to the total volume of the heat medium increased in the heating operation mode. FIG. 10 is a graph illustrating the ratio of the time the heat medium takes to reach a predetermined temperature relative to the total volume of the heat medium increased by the elements, for example, extension pipes and the heat storage tank, in the heat medium circuit B. The configuration of each heat medium circuit B, for example, the lengths of the pipes 5 and the heat storage tank, may be determined based on the graph in order to control the total volume of the heat medium by estimating the time the heat medium takes to reach the predetermined temperature upon shifting between the operation modes which causes a change in temperature in such a system.

Each of the first heat medium flow switching devices 32 and the second heat medium flow switching devices 33 described in Embodiment may include a component that can switch between passages, for example, a three-way valve capable of switching between flow directions in a three-way passage or two two-way valves, such as on-off valves, opening or closing a two-way passage used in combination. Alternatively, a component, such as a stepping-motor-driven mixing valve, capable of changing a flow rate in a three-way passage may be used, or, two components, such as electronic expansion valves, capable of changing a flow rate in a two-way passage may be used in combination as each of the first heat medium flow switching devices 32 and the second heat medium flow switching devices 33. In this case, water hammer caused when a passage is suddenly opened or closed can be prevented. Although Embodiment has been described with respect to the case where the heat medium flow rate control devices 34 each include a two-way valve, each of the heat medium flow rate control devices 34 may include a control valve having a three-way passage and the valve may be disposed together with a bypass pipe that bypasses the corresponding use side heat exchanger 35.

As regards each of the heat medium flow rate control devices 34, a component capable of controlling a flow rate through a passage in a stepping-motor-driven manner may be used. Alternatively, a two-way valve or a three-way valve whose one end is closed may be used. Alternatively, as regards each of the heat medium flow rate control devices 34, a component, such as an on-off valve, opening or closing a two-way passage may be used such that an average flow rate is controlled while ON and OFF operations are repeated.

Although each second refrigerant flow switching device 28 is illustrated as a four-way valve, the device is not limited to this valve. A plurality of two-way or three-way flow switching valves may be used such that the refrigerant flows in the same way.

As regards the heat medium, for example, brine (antifreeze), water, a mixed solution of brine and water, or a mixed solution of water and an additive with a high corrosion protection effect can be used. In the air-conditioning apparatus 100, therefore, if the heat medium leaks into the indoor space 7 through the indoor unit 3, the safety of the heat medium used is high. This contributes to safety improvement.

Although Embodiment has been described with respect to the case where the air-conditioning apparatus 100 includes the accumulator 19, the accumulator 19 may be omitted. The heat source side heat exchanger 12 and each of the use side heat exchangers 35 are typically provided with the air-sending device that sends air to promote condensation or evaporation. The configuration is not limited to this case. For example, a panel heater that uses radiation can be used as the use side heat exchanger 35 and a water-cooled heat exchanger that transfers heat through water or antifreeze can be used as the heat source side heat exchanger 12. In other words, the heat source side heat exchanger 12 and the use side heat exchanger 35 may be any type of heat exchanger capable of transferring heat or removing heat.

Although Embodiment has been described with respect to the case where the four use side heat exchangers 35 are arranged, any number of use side heat exchangers may be arranged. In addition, although Embodiment has been described with respect to the case where the two intermediate heat exchangers 25, the intermediate heat exchanger 25*a* and the intermediate heat exchanger 25*b*, are arranged, the arrangement is not limited to this case. As long as each intermediate heat exchanger 25 is capable of cooling or/and heating the heat medium, any number of intermediate heat exchangers 25 may be arranged. As regards each of the pumps 31*a* and 31*b*, the number of pumps is not limited to one. A plurality of pumps having a small capacity may be arranged in parallel.

As described above, the air-conditioning apparatus 100 according to Embodiment achieves improvement of comfort upon actuation of the indoor unit 3, as well as improvement of safety achieved by keeping the heat source side refrigerant from being circulated through or near the indoor units 3. Upon switching between the operation modes which causes a change in temperature of the heat medium, for example, upon switching from the non-operation mode to another operation mode in which any of the indoor units performs the cooling operation or the heating operation or upon switching from one of the heating only operation mode and the cooling only operation mode to the other one, the heat medium temperature is changed to a predetermined temperature and the air-sending device in the indoor unit 3 is then actuated to prevent warm air from being sent in the cooling operation mode or prevent cold air from being sent in the heating operation mode, thus achieving the improvement of comfort.

REFERENCE SIGNS LIST

1 outdoor unit, 2 relay unit, 3 indoor unit, 3*a* indoor unit, 3*b* indoor unit, 3*c* indoor unit, 3*d* indoor unit, 4 refrigerant pipe, 4*a* refrigerant connecting pipe, 4*b* refrigerant connecting pipe, 5 pipe (heat medium conveying pipe), 6 outdoor space, 7 indoor space, 8 space, 9 structure, 10 compressor, 11 first refrigerant flow switching device, 12 heat source side heat exchanger, 13*a* check valve, 13*b* check valve, 13*c* check valve, 13*d* check valve, 19 accumulator, 20 bypass pipe, 25 intermediate heat exchanger, 25*a* intermediate heat exchanger, 25*b* intermediate heat exchanger, 26 expansion device, 26*a* expansion device, 26*b* expansion device, 27 opening and closing device, 28 second refrigerant flow switching device, 28*a* second refrigerant flow switching device, 28*b* second refrigerant flow switching device, 29 opening and closing device, 31 pump, 31*a* pump, 31*b* pump, 32 first heat medium flow switching device, 32*a* first heat medium flow switching device, 32*b* first heat medium flow switching device, 32*c* first heat medium flow switching device, 32*d* first heat medium flow switching device, 33 second heat medium flow switching device, 33*a* second heat medium flow switching device, 33*b* second heat medium flow switching device, 33*c* second heat medium flow switching device, 33*d* second heat medium flow switching device, 34 heat medium flow rate control device, 34*a* heat medium flow rate control device, 34*b* heat medium flow rate control device, 34*c* heat medium flow rate control device,

34*d* heat medium flow rate control device, 35 use side heat exchanger, 35*a* use side heat exchanger, 35*b* use side heat exchanger, 35*c* use side heat exchanger, 35*d* use side heat exchanger, 40 temperature sensor, 40*a* temperature sensor, 40*b* temperature sensor, 50 controller, 70 temperature sensor, 100 air-conditioning apparatus, A refrigerant circuit, B heat medium circuit

The invention claimed is:

1. An air-conditioning apparatus comprising:

a refrigerant circuit through which a heat source side refrigerant is circulated, the refrigerant circuit including a compressor, a heat source side heat exchanger, a plurality of decompressors, and refrigerant passages of a plurality of intermediate heat exchangers which are connected by refrigerant pipes;

a heat medium circuit through which a heat medium is circulated, the heat medium circuit including a plurality of pumps, a plurality of use side heat exchangers consisting of heat medium heat exchangers, and heat medium passages of the plurality of intermediate heat exchangers which are connected by heat medium conveying pipes, wherein the plurality of intermediate heat exchangers exchange heat between the heat source side refrigerant and the heat medium;

a plurality of indoor units each including one of the plurality of use side heat exchangers and a corresponding fan configured to supply airflow for heat exchange, each of the plurality of use side heat exchangers including a non-operation mode with the corresponding fan being in a non-operation state and an operational mode with a heat exchange with the corresponding fan initially being in the non-operation state, the operational mode with the heat exchange including a cooling operation mode and a heating operation mode and requiring the heat exchange between air supplied by the corresponding fan and the heat medium conveyed to each use side heat exchanger to cool or heat the supplied air; and a controller configured to control operation of the air-conditioning apparatus including a plurality of operational modes, one operational mode including a state in which all of the plurality of indoor units are in the non-operation mode, and the controller changing operation of the air-conditioning apparatus from the state in which all of the plurality of indoor units are in the non-operation mode by switching at least one of the plurality of indoor units from the non-operational mode to another of the operational modes selected from the operation cooling mode and the operation heating mode, wherein the switching includes the controller issuing a start instruction to at least one indoor unit of the plurality of indoor units that switches the at least one of the plurality of indoor units from the non-operation mode to the cooling operation mode or the heating operation mode, and the heat medium conveyed to one of the plurality of use side heat exchangers included in the at least one indoor unit which has received the start instruction is cooled or heated until a predetermined time has elapsed at which the heat medium reaches a predetermined temperature, the predetermined time being determined from a total volume of the heat medium in the heat medium circuit, and after the predetermined time has elapsed, actuating the corresponding fan included in the at least one of the plurality of indoor units which has received the start instruction.

2. The air-conditioning apparatus of claim 1, wherein the controller issues an operation mode change instruction to at least one of the plurality of indoor units that is performing the cooling operation mode or the heating operation mode, the heat medium conveyed to one of the plurality of use side heat exchangers included in one of the plurality of indoor units which has received the operation mode change instruction is cooled or heated until another predetermined time has elapsed at which the heat medium reaches the predetermined temperature, the predetermined time being assumed from the total volume of the heat medium in the heat medium circuit, and after that, the corresponding fan included in at least one of the plurality of indoor units which has received the operation mode change instruction is actuated.

3. An air-conditioning apparatus comprising:

a refrigerant circuit through which a heat source side refrigerant is circulated, the refrigerant circuit including a compressor, a heat source side heat exchanger, a plurality of refrigerant decompressors, and refrigerant passages of a plurality of intermediate heat exchangers which are connected by refrigerant pipes;

a heat medium circuit through which a heat medium is circulated, the heat medium circuit including a plurality of pumps, a plurality of use side heat exchangers consisting of heat medium heat exchangers, heat medium passages of the plurality of intermediate heat exchangers which are connected by heat medium conveying pipes including a temperature sensor on an inlet side of each of the plurality of use side heat exchangers, wherein the plurality of intermediate heat exchangers exchange heat between the heat source side refrigerant and the heat medium;

a plurality of indoor units each including one use side heat exchanger from the plurality of use side heat exchangers, and a corresponding fan configured to supply airflow to the one of the plurality of use side heat exchangers, each of the plurality of indoor units having operational modes that include a non-operation mode with the corresponding fan being in a non-operation state and an operational mode with a heat exchange with the corresponding fan initially being in the non-operation state, the operational mode with the heat exchange including a cooling operation mode that cools the heat medium conveyed to the included one use side heat exchanger and a heating operation mode that heats the heat medium conveyed to the included one use side heat exchanger; and a controller configured to control operation of the air-conditioning apparatus including a plurality of operational modes including a state in which all the indoor units are in the non-operation mode and a state in which at least one of the plurality of indoor units is in one of the operational modes with the heat exchange, wherein the controller changes operation of the air-conditioning apparatus from the state in which all the indoor units are in the non-operation mode to a state in which at least one of the plurality of indoor units is in one of the operational modes by switching at least one of the plurality of indoor units from the non-operational mode to one of the operational modes with the heat exchange, the switching by the controller includes the controller issuing a start instruction to the at least one indoor unit of the plurality of indoor units and switching the at least one indoor unit of the plurality of indoor units from the non-operation mode to one of the cooling operation mode or the heating operation mode and respectively cooling or heating the heat medium conveyed to the one use side heat exchanger included in the at least one indoor unit of the plurality of indoor units which has received the start instruction until a predetermined time has elapsed at which the heat medium reaches a predetermined temperature as measured by the corresponding temperature sensor, the predetermined time being determined from a total volume of the heat medium in the heat medium circuit, and after the predetermined time has elapsed, actuating the corresponding fan included in the at least one indoor unit of the plurality of indoor units.

4. The air-conditioning apparatus of claim 2, wherein the controller switches operation of at least one of the plurality of indoor units that is performing one of the cooling operation mode or the heating operation mode to another of the cooling operation mode or the heating operation mode by issuing an operation mode change instruction to the at least one of the plurality of indoor units, and the heat medium conveyed to the use side heat exchanger included in the at least one indoor unit which has received the operation mode change instruction is cooled or heated until another predetermined time has elapsed at which the heat medium reaches the predetermined temperature.

* * * * *